US006324360B1

(12) United States Patent
Yoneoka

(10) Patent No.: US 6,324,360 B1
(45) Date of Patent: Nov. 27, 2001

(54) IMAGE FORMING SYSTEM HAVING AN AFTER-PROCESSING APPARATUS

(75) Inventor: Hideharu Yoneoka, Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/493,176

(22) Filed: Jan. 28, 2000

(30) Foreign Application Priority Data

Jan. 29, 1999 (JP) ..... 11-021703

(51) Int. Cl.[7] ..... G03G 15/00; G03G 21/00
(52) U.S. Cl. ..... 399/82
(58) Field of Search ..... 399/82, 85, 403, 399/407, 410; 270/58.02

(56) References Cited

U.S. PATENT DOCUMENTS 5,060,922 * 10/1991 Shibusawa et al. ..... 270/58.09
5,568,247 * 10/1996 Murata et al. ..... 399/410
5,758,251 * 5/1998 Takahashi et al. ..... 399/410 X
5,835,839 * 11/1998 Kaneda ..... 399/403 X

* cited by examiner

*Primary Examiner*—Fred L Braun
(74) *Attorney, Agent, or Firm*—Nixon Peabody LLP; Donald R. Studebaker

(57) ABSTRACT

An image forming system including an image forming apparatus, one or more sorters for after-processing image-formed sheets discharged from the image forming apparatus, mode selector for selecting a sheet after-processing mode, detector for detecting the presence of sheets stored in the sheet after-processing apparatus, and controller responsive to detection by the sheet detector of presence in the sheet after-processing apparatus of sheets stored in a certain mode for disabling operation of the image forming apparatus when an operating mode using the sheet after-processing apparatus that is different from the certain mode is selected by the mode sector.

3 Claims, 22 Drawing Sheets

FIG. 11

SELECT TOWER. PRESS OK TO ACCEPT

TOWER 1 TOWER 2

FIG. 12

USE TOWER?
PRESS OK TO ACCEPT

YES NO

IMAGE FORMING SYSTEM HAVING AN AFTER-PROCESSING APPARATUS

BACKGROUND OF THE INVENTION

1. Field of the Invention

The present invention relates to an image forming system, particularly to an image forming system including a stencil printer or other such image forming apparatus and any of various sheet after-processing apparatuses connected to the image forming apparatus.

2. Description of the Related Art

Sheet after-processing apparatuses that are combined with an image forming apparatus such as a stencil printer to constitute an image forming system include, for example, sorters for collating and stapling the printed sheets after printing. Among the operating modes using a sorter are included:

(1) Sort mode in which printed sheets are successively sorted by page into multiple sorter bins to produce printed documents, pamphlets, books or the like.

(2) Group mode in which multiple documents are sorted into groups and stored in bins to carry out multiple sorting by document of (sheets×groups).

(3) Dry mode in which printed sheets are sequentially distributed into multiple bins one by one to reduce the amount of transfer printing to the backs of the overlaid sheets.

Operation is also possible in a non-sort mode in which printed sheets are discharged directly onto a sheet output tray without being collated. As the sheet output tray is attached to the image forming apparatus, the non-sort mode can be used to conduct image forming operation even when the sorter is inoperable. Stapling is an operation ordinarily conducted in sort mode.

One problem with such a sorter is that after a first batch of printed sheets has been sorted in one mode, a second batch may be sorted on top of the first in another mode. For instance, printed sheets may be sorted in group mode on top of printed sheets collated in sort mode. This makes the collated printed sheets useless and also causes them to get mixed in with the printed sheets sorted on top of them and the operator has to go to considerable extra work to separate the printed sheets manually.

When an error arises in the sorter, such as when the sorter door is not properly closed, the sorter remains inoperable even after sort mode is selected. To conduct printing, therefore, it is necessary to change the selected mode to one that does not use the sorter, i.e., to non-sort mode.

SUMMARY OF THE INVENTION

In light of the foregoing circumstances, an object of the present invention is to provide an image forming system that disables operation of the image forming apparatus or issues a warning in response to the selection of an operating mode using the sheet after-processing apparatus that is different from the operating mode used to store sheets already present in the sheet after-processing apparatus, thereby eliminating the inconvenience caused when sheets processed in a later selected operating mode are deposited on top of sheets processed in an earlier selected operating mode.

An image forming system according to a first aspect of the present invention comprises:

an image forming apparatus for forming desired images on sheets and discharging the image-formed sheets, a sheet after-processing apparatus connected to the image forming apparatus and capable of after-processing the image-formed sheets discharged from the image forming apparatus in any of multiple operating modes, mode selection means for selecting a sheet after-processing operating mode of the sheet after-processing apparatus, detection means for detecting presence of sheets stored in the sheet after-processing apparatus, and control means responsive to detection by the sheet detection means of presence in the sheet after-processing apparatus of sheets stored in a certain mode for disabling operation of the image forming apparatus when an operating mode using the sheet after-processing apparatus that is different from the certain mode is selected by the mode selection means.

An image forming system according to a second aspect of the present invention comprises:

an image forming apparatus for forming desired images on sheets and discharging the image-formed sheets, a sheet after-processing apparatus connected to the image forming apparatus and capable of after-processing the image-formed sheets discharged from the image forming apparatus in any of multiple operating modes, mode selection means for selecting a sheet after-processing operating mode of the sheet after-processing apparatus, detection means for detecting presence of sheets stored in the sheet after-processing apparatus, and notification means responsive to detection by the sheet detection means of presence in the sheet after-processing apparatus of sheets stored in a certain mode for issuing an error notice when an operating mode using the sheet after-processing apparatus that is different from the certain mode is selected by the mode selection means.

The error notice can be effected by an alarm or an error display.

A third aspect of the invention provides an image forming system according to the first or second aspect, which further comprises an abnormality detection means for detecting abnormality of the sheet after-processing apparatus and wherein automatic selection of an operating mode not using the sheet after-processing apparatus is effected when the abnormality detection means detects abnormality of the sheet after-processing apparatus at a time when an operating mode using the sheet after-processing apparatus has been selected by the mode selection means.

The image forming system according to the first aspect of the present invention prevents sheets processed in a later selected operating mode from being deposited on top of sheets processed in an earlier selected operating mode.

The image forming system according to the second aspect of the present invention prevents sheets processed in a later selected operating mode from being deposited on top of sheets processed in an earlier selected operating mode unnoticed by the operator.

The image forming system according to the third aspect responds to an error arising in the sorter, such as failure of the sorter door to close properly, by automatically setting a mode not using the sheet after-processing apparatus even if a mode using the sheet after-processing apparatus is selected. This saves the operator from the trouble of resetting the operating mode of the sheet after-processing apparatus.

BRIEF DESCRIPTION OF THE DRAWINGS

FIG. 11 is a diagram showing a sorter tower selection screen.

FIG. 12 is a diagram showing a sorter tower use/nonuse selection screen,

DESCRIPTION OF THE PREFERRED EMBODIMENT

The present invention will now be described in further detail with reference to the accompanying drawings.

Figure 1:
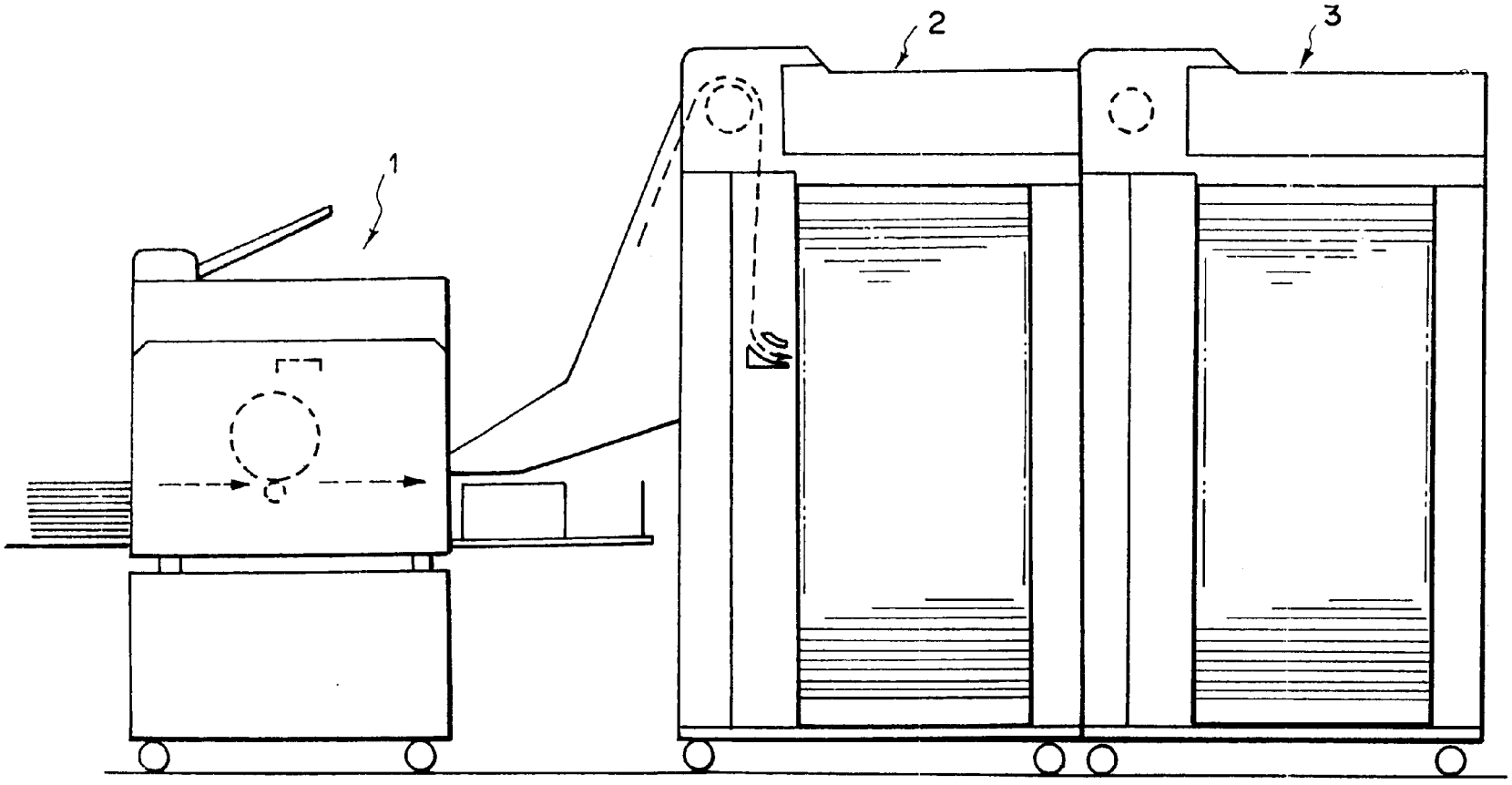
FIG. 1 is a diagram showing the overall configuration of an image forming system that is an embodiment of the present invention.

FIG. 1 is a diagram showing the configuration of an image forming system that is an embodiment of the present invention. As shown in FIG. 1, the image forming system according of this embodiment consists of a printer unit 1 as an image forming apparatus, and, as sheet after-processing apparatuses, a first sorter 2 connected to the printer unit 1 and a second sorter 3 connected to the first sorter 2.

Printer Unit

Figure 2:
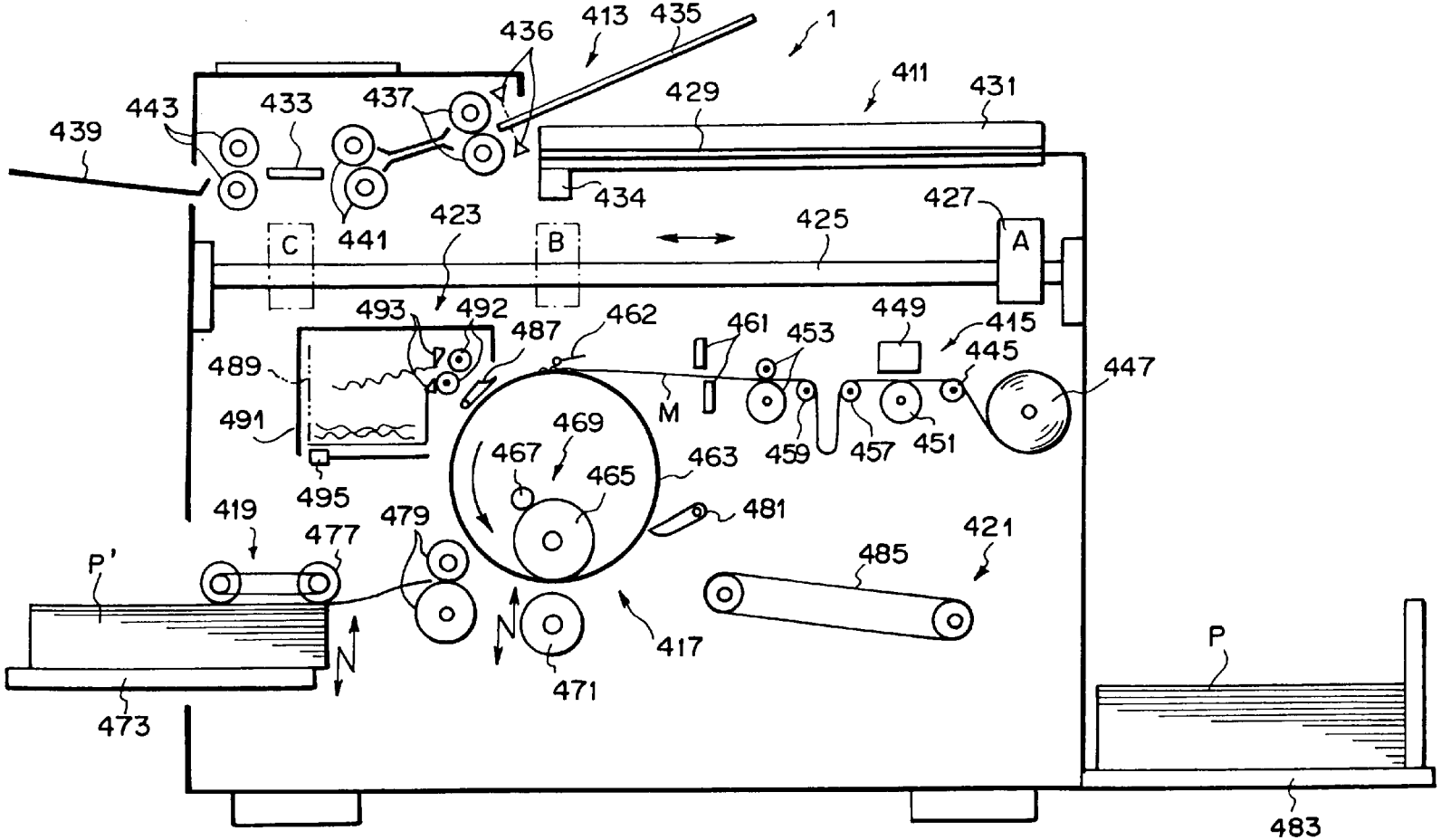
FIG. 2 is a diagram showing the structure of the printer unit of FIG. 1.

FIG. 2 is a diagram showing the structure of the printer unit 1 serving as the image forming apparatus of the image forming system. The printer unit 1 is a stencil printer equipped with a stencil maker. The printer unit 1 is equipped with an original document reading section 411, an automatic document feeder (hereinafter referred to as ADF or ADF unit) 413, a stencil making section 415, a printing section 417, a sheet feeding section 419, a sheet discharge section 421, and a stencil discard section 423.

The document reading section 411 has a line image sensor 427 supported on guide rails 425 (only one shown) to move in the direction of arrow A in FIG. 2, a document glass 429 for placing an original such as a book, a pressure plate 431 provided on the document glass 429 to be openable/closable, a target glass plate 433 to which an original sheet is fed by the ADF 413, and an original sensor 434 provided on the pressure plate side for detecting the presence of an original document on the document glass 429. When a book type original is read, an unshown drive device is operated to drive the line image sensor 427 along the guide rails 425 under the document glass 429 to effect scanning at a prescribed speed between a home position designated by the symbol A and a scan end position designated by the symbol B. When an original sheet is read using the ADF 413, the line image sensor 427 is moved to and made stationary at a position directly under the target glass plate 433 as indicated by the symbol C.

The ADF 413 has an original input tray 435 for holding a stack of original sheets, original pickup rollers 437 for feeding the original sheets on the original input tray 435 toward the top of the target glass plate 433 one by one, an original output tray 439 for receiving original sheets after reading, original feed rollers 441 located upstream of the target glass plate 433 relative to the direction of original sheet conveyance for feeding originals from the original input tray 435 across the top of the target glass plate 433 at a prescribed scanning speed, original feed rollers 443 located downstream of the target glass plate 433 for discharging original sheets from the target glass plate 433 to the original output tray 439, and an ADF original sensor 436 for optically detecting the presence of original sheets on the original input tray 435.

The original sheets placed on the original input tray 435 of the ADF 413 are picked up individually by the original pickup rollers 437 and conveyed to the upper surface of the target glass plate 433 by the original feed rollers 441. As an original sheet passes over the target glass plate 433, it is subjected to image reading by the line image sensor 427 stationed at position C under the target glass plate 433. After being read, the original sheet is discharged to the original output tray 439 by the original feed rollers 443.

The stencil making section 415 has a stock roll section 447 for stocking heat-sensitive stencil paper M in the form of a web, a thermal head 449 composed of multiple dot heating elements arrayed in lines perpendicular to the conveyance direction of the stencil paper M, a platen roller 451 facing the thermal head 449, stencil paper feed rollers 453, stencil paper guide rollers 445, 457 and 459, and a stencil paper cutter 461. Image data representing the original image read by the line image sensor 427 are input to the stencil making section 415 and the individual dot heating elements of the thermal head 449 are selectively heated in accordance with the input image data to produce a stencil by thermally perforating the heat-sensitive stencil paper M in a dot matrix pattern. The stencil paper M is cut by a cutter 461 after stencil making.

The printing section 417 has a stencil drum 463 of porous ink-permeable structure which is equipped on its outer surface with a stencil clamp section 462 for clamping the leading end of a stencil to be wound thereabout and is driven to rotate about its own center of rotation counterclockwise as seen in FIG. 2, an ink squeezer 469 including a squeegee roller 465 and a doctor rod 467 located inside the stencil drum 463, and a press roller 471 for pressing cut-sheet printing paper onto the ink squeezer 469. A stencil supplied from the stencil making section 415 is wound on the outer surface of the stencil drum 463.

The sheet feeding section 419 has a sheet feeder tray 473 for stacking sheets of printing paper P', sheet feed rollers 477 for feeding out sheets of printing paper P' one at a time, and timing rollers 479 for feeding sheets of printing paper P' between the stencil drum 463 and the press roller 471.

Figure 3A:
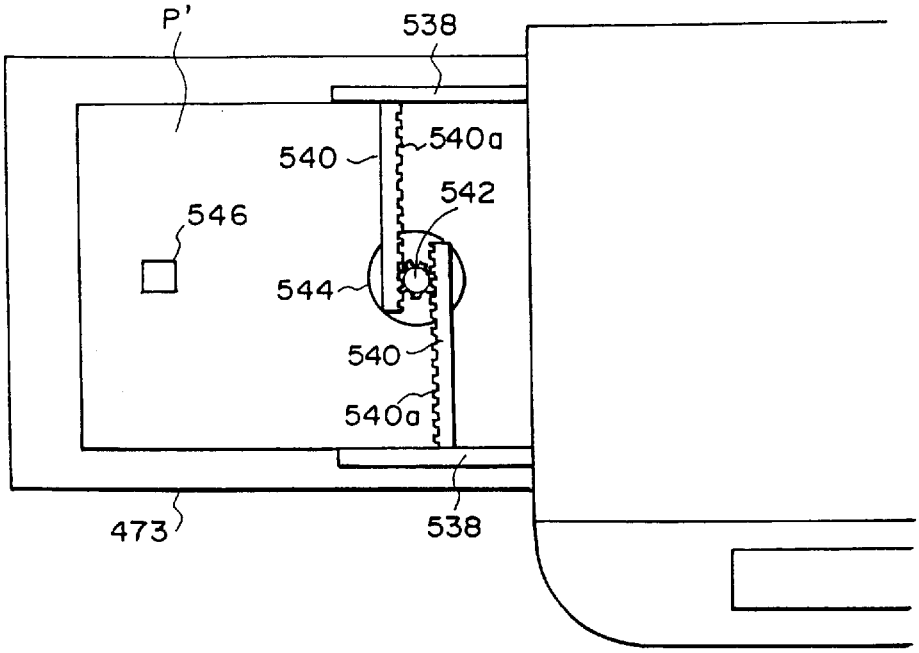
FIG. 3*a* is a plan view of the sheet feeder tray of FIG. 2.
Figure 3B:
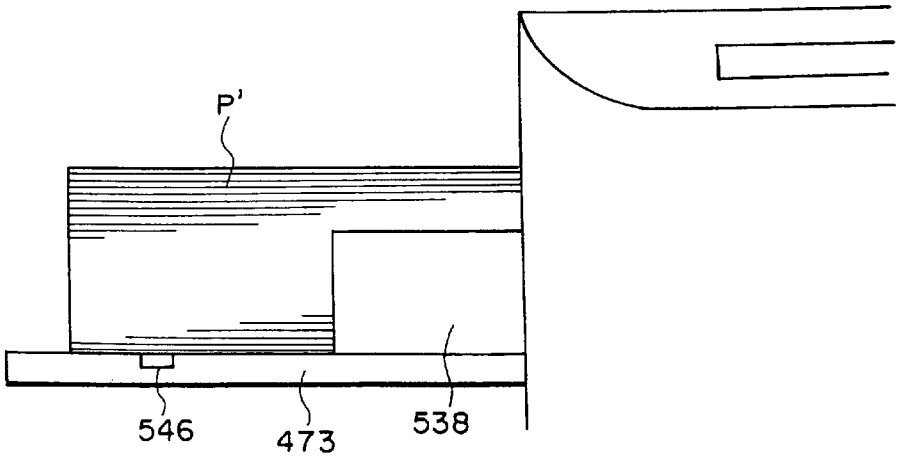
FIG. 3*b* is a side view of the sheet feeder tray of FIG. 2.

FIGS. 3(*a*) and 3(*b*) show plan and side views of the sheet feeder tray 473 structure. As shown, guide plates 538 are provided in facing relationship one on either side of the sheet feeder tray 473 to retain and guide the cut-sheet printing paper P' by maintaining contact with the opposite side edges thereof. A rack 540 is attached to each guide plate 538. The racks 540 are provided inside the sheet feeder tray 473 to project along the surface of the sheet feeder tray 473 perpendicularly to the direction in which the sheets of printing paper P' are fed. The racks 540 are fixed with their toothed sides 540*a* facing each other across a prescribed interval in the direction of the printing paper P' feed.

The toothed side 540*a* of each rack 540 engages with a pinion 542 provided at the middle portion of the sheet feeder tray 473 near its feed-out end. A potentiometer 544 linked with the shaft of the pinion 542 under the sheet feeder tray 473 produces an output voltage that varies with the rotational position of the pinion 542. When the spacing between the guide plates 538 is changed to match the size of the printing paper P', the racks 540 move simultaneously in opposite directions and rotate the pinion 542, whereby the output of the potentiometer 544 on the shaft of the pinion 542 changes. The width of the printing paper P' in the scanning direction is determined from the magnitude of the output.

A paper sensor 546 for detecting presence/absence of printing paper P' in the sheet feeder tray 473 is provided at the rear center of the sheet feeder tray 473. The paper sensor 546 detects whether or not the length of the printing paper P' in the sub-scanning direction is greater than a prescribed value. The potentiometer 544 and the paper sensor 546 are members of a paper size detector that discriminates the size of the printing paper P' and provides paper size information, such as whether the paper is of standard or nonstandard size. In the present embodiment, the main scanning direction lies perpendicular to the conveyance direction of the printing paper P' and the sub-scanning direction lies in the conveyance direction of the printing paper P'.

The sheet discharge section 421 has a stripping claw 481 for stripping printed sheets P off the stencil drum 463, a non-sort output tray 483 for stacking the printed sheets P, and a belt-type discharge conveyor 485 for conveying printed sheets P stripped off the stencil drum 463 by the stripping claw 481 to the non-sort output tray 483.

The stencil discard section 423 has a stencil detacher claw 487 for peeling stencil papers (stencils) M wound on the outer surface of the stencil drum 463 off the stencil drum 463, a box support 491 for detachably supporting a discarded stencil box 489 for depositing discarded stencils M, and rollers 492 for delivering the discarded stencils M peeled off the stencil drum 463 by the stencil detacher claw 487 into the discarded stencil box 489. A discarded stencil sensor 493 of photoelectric type is provided at the entrance to the discarded stencil box 489 to detect delivery of the discarded stencils M into the discarded stencil box 489. The stencil discard section 423 is further equipped with a box-actuated switch 495 for detecting whether the discarded stencil box 489 is attached to the box support 491.

When stencil printing is conducted with this stencil printer, the stencil drum 463 is driven by an unshown drive unit to rotate about its own center of rotation counterclockwise as seen in FIG. 2 and the timing rollers 479 operate at the proper timing relative to the rotation of the stencil drum 463 to feed a sheet of the printing paper P' from the sheet feeder tray 473 to between the stencil drum 463 and the press roller 471. The press roller 471 presses the printing paper P' onto the stencil M on the outer surface of the stencil drum 463 to effect press-wise stencil printing.

The printed sheet P is stripped from the stencil drum 463 by the stripping claw 481, conveyed to the non-sort output tray 483 by the discharge conveyor 485, and stacked on the non-sort output tray 483 with its image-printed side facing up. When the stencil M has served its purpose, it is detached from the stencil drum 463 by the stencil detacher claw 487 and delivered to the discarded stencil box 489 by the rollers 492.

Sorters

The sorters 2 and 3 serving as sheet after-processing apparatuses in this embodiment will now be explained.

Figure 4:
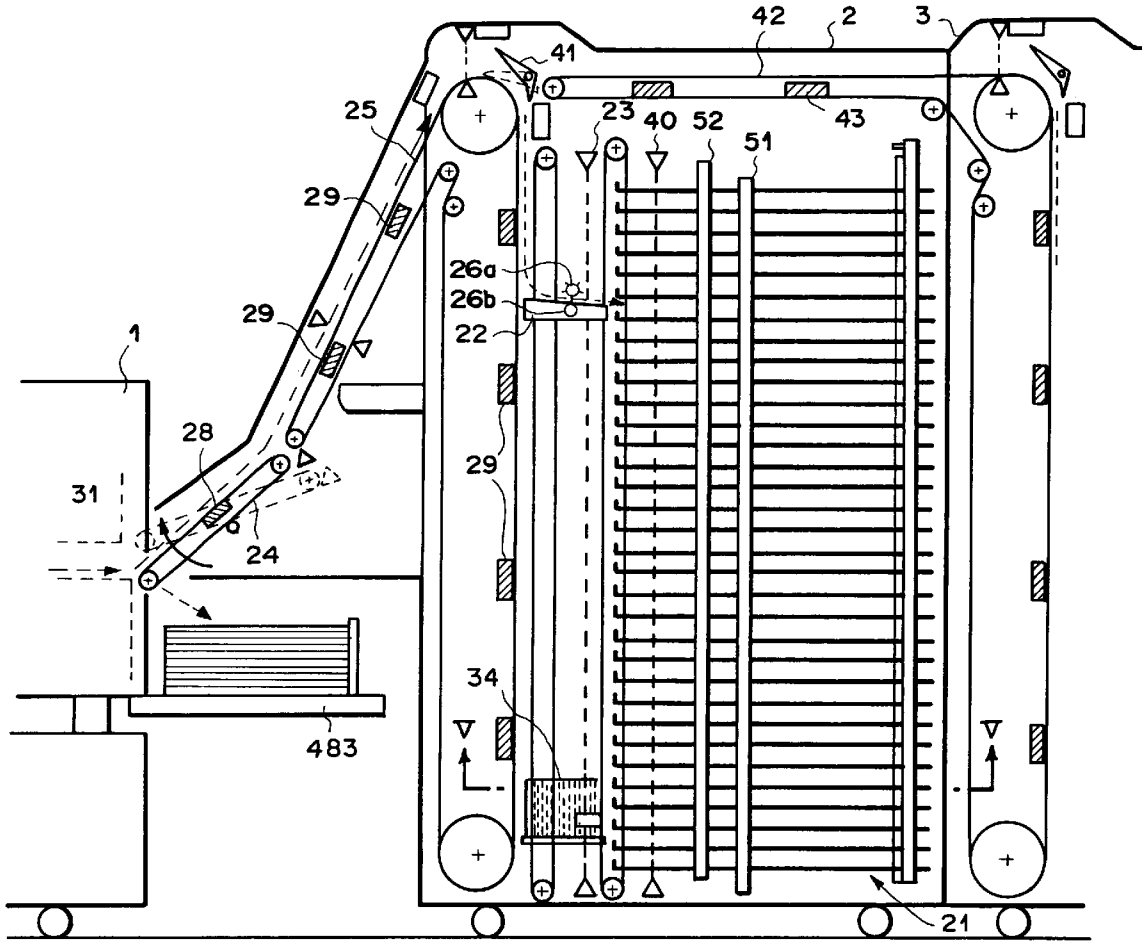
FIG. 4 is diagram showing the structure of the sorter of FIG. 1.

FIG. 4 shows the structure of the first sorter 2 of this embodiment of the present invention. As shown, the sorter 2 is equipped with a vertical row of bins 21 for holding printed sheets P, an indexer 22 for inserting printed sheets P into the bins 21, an indexer sensor 23 for detecting whether the printed sheets P are reliably inserted into the bins 21, and conveyor belts 24 and 25 for conveying printed sheets P discharged from the printer unit 1 to the bins 21.

The indexer 22 is driven vertically by an unshown DC servo motor. As it moves, it sequentially inserts printed sheets P into the bins 21 in proper order while the indexer sensor 23 checks that each insertion is properly executed. The indexer 22 is equipped with a pair of rollers 26*a* and 26*b* that pinch the printed sheet P from opposite sides. When the upper roller 26*a* moves down into pressure contact with the lower roller 26*b*, the rollers 26*a*, 26*b* pinch the printed sheet P conveyed therebetween and impart it with force to convey it into a bin. Even a printed sheet P or the like that is limp and hard to convey can therefore be reliably conveyed without failure owing to the fact that it is caught between the two rollers. Soiling of the printed surface of the printed sheet P conveyed as pinched between the rollers 26*a*, 26*b* can be minimized by forming the surface of the upper roller 26*a* that contacts the printed surface with sharp, needle-like protrusions. Soiling of the printed surface can also be prevented by separating the upper roller 26*a* from the lower roller 26*b* to release the printed sheet P from the pinched state.

The conveyor belts 24, 25 are driven by unshown DC motors. Suction fans 28 and 29 are provided near the conveyor belts 24, 25 to supply negative pressure for sucking the printed sheets P onto the conveyor belts 24, 25. The suction produced by the suction fans 28, 29 enables the printed sheets P discharged from the printer unit 1 to be conveyed to the bins 21 under suction attachment. The conveyor belt 24 and the suction fan 28 constitute a conveyance path 31 for mode switching. The conveyance path 31 can be selectively driven by an unshown drive mechanism to either of the positions indicated by the solid and broken lines in FIG. 4. When the mode-switching conveyance path 31 is raised (broken line in FIG. 4), the printed sheets P discharged from the printer unit 1 pass under the conveyance path 31 into the non-sort output tray 483. When the conveyance path 31 is lowered (solid line), the printed sheets P discharged from the printer unit 1 are sucked onto the conveyor belt 24 and conveyed to the first sorter 2. The mode-switching conveyance path 31 is initially in the raised position. It is left in this position during operation in the non-sort mode, which does not use the sorting bins of the first sorter 2. When the selected mode is one that utilizes the sorting bins of the first sorter 2, i.e., when it is the sort mode, group mode or dry mode, the conveyance path 31 is controlled to swing to the lowered position at the start and to return to the initial state upon completion of the sorting job.

The first sorter 2 is equipped with alignment rods 51, 52 and 53 driven by unshown pulse motors for aligning the printed sheets P inserted into the bins 21, and with a stapler 34 driven vertically in FIG. 4 by an unshown pulse motor for stapling the printed sheets P inserted into each bin 21, one bin at a time starting from the topmost.

The row of bins 21 is equipped with a sheet sensor 40 capable of detecting whether printed sheets P are present in any of the bins 21.

The second sorter 3 is also equipped with a vertical row of bins and an indexer and has the same structure as the first sorter 2. When the first sorter 2 fills up, an unshown solenoid operates a sorter switch plate 41 of the first sorter 2 to switch the paper conveyance path to the second sorter 3 side. This causes the printed sheets P to be conveyed to the second sorter 3 by the action of a conveyor belt 42 and suction fans 43 provided above the row of bins 21. Upon reaching the second sorter 3, the printed sheets P are sorted into the bins of the second sorter 3 by the indexer (neither bins nor indexer shown).

Alignment Rods, Stapler

Figure 5:
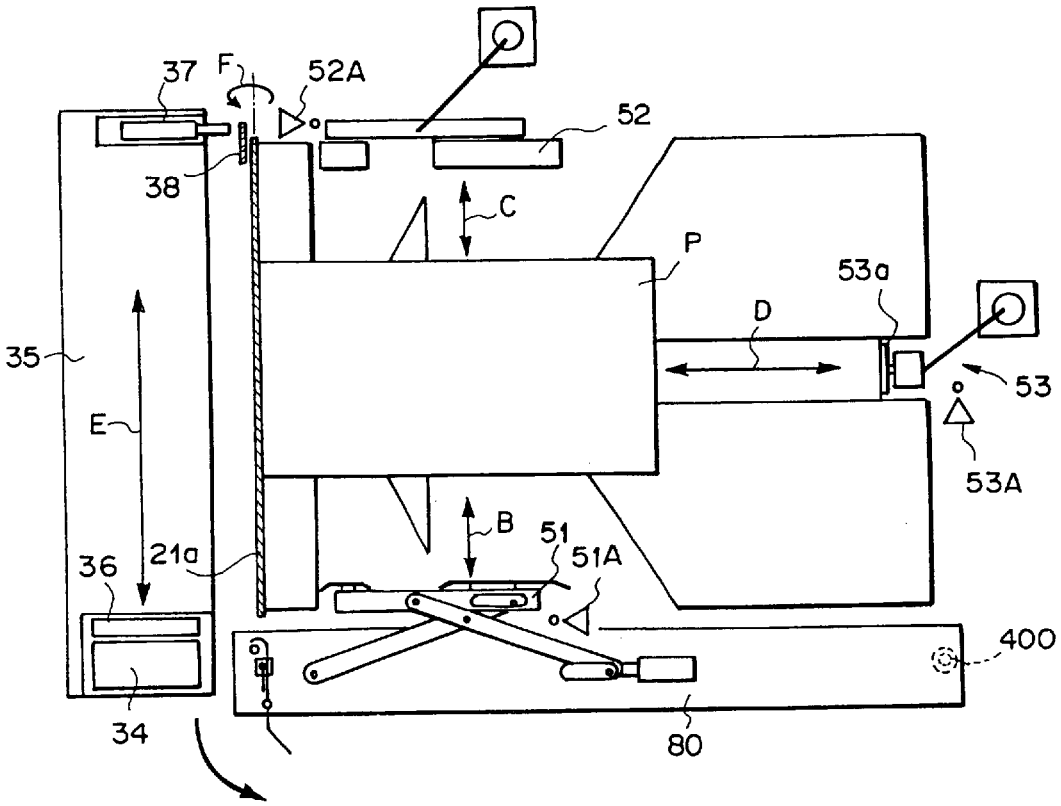
FIG. 5 is sectional view taken along line V—V in FIG. 4.

FIG. 5 is sectional view taken along line V—V in FIG. 4 showing structure of the bins 21, alignment rods 51, 52, 53 and stapler 34 of the sorter 2 in detail.

The alignment rods 51 and 52 move perpendicularly to the conveyance direction of the printed sheets P, as indicated by the arrows B and C, respectively. The alignment rod 51 operates first to center the printed sheets P in the bins and the alignment rod 52 thereafter moves perpendicularly to the conveyance direction of the printed sheets P to sandwich the printed sheets P between itself and the alignment rod 51, thereby aligning the printed sheets P. The alignment rod 53 moves in parallel with the conveyance direction of the printed sheets P, as indicated by arrow D, and operates to align the printed sheets P by pushing them against an upright gate 21*a* at the end of each bin. The upright gates 21*a* are biased by springs or other energizing means to rotate in the direction opposite from that indicated by the arrow F in FIG. 5. The range of their rotation is limited by an unshown member so as to stop them at the position where they contact the ends of the printed sheets P on the upstream side relative to the conveyance direction of the printed sheets P. An upright gate tilt lever 38 is fastened on each upright gate 21*a*. When a stapler unit 35 moves downward with a solenoid 37 (explained later) turned ON (with a movable portion thereof projecting toward the lever 38), the movable portion of the solenoid 37 pushes the lever 38 down to rotate the upright gate 21*a* to its horizontal position. Home position (HP) sensors 51A, 52A and 53A are provided for detecting whether the alignment rods 51, 52, 53 are in home position (HP).

The stapler 34 is installed in the stapler unit 35 to be movable in the direction of arrow E together with an in-pusher 36 for pushing the printed sheets P back into the bins as explained later. The solenoid 37 for tilting the upright gates 21*a* at the ends of the bins is mounted on the stapler unit 35.

When the stapler 34 is used, stapling is begun after all of the printed sheets P have been aligned. Upon completion of the alignment, the indexer 22 retreats to the top of the conveyor section and the stapler unit 35 moves to a location above the uppermost bin by the height of one bin (hereafter called the "0th bin position"). The solenoid 37 is then turned ON to ride on the lever 38 of the 1st bin, whereafter the stapler unit 35 is lowered to the 1st bin to open its upright gate 21*a*. An out-pusher 53*a* mounted on the alignment rod 53 is then lowered to the bin at which stapling is to be started and the alignment rod 53 is moved toward the printed sheets P so that the printed sheets P in the bin concerned are pushed toward the stapler unit 35 by the pusher 53*a*. The pushed-out printed sheets P are then stapled by the stapler 34. When the stapling is finished, the in-pusher 36 mounted at the side of the stapler 34 pushes the stapled sheets P back into the bin and solenoid 37 turns OFF to allow the upright gate 21*a* to close. The foregoing process is then repeated to effect stapling at every bin where printed sheets P are present. The foregoing explanation also applies to the stapler and alignment rods of the second sorter 3.

Operation Panel

Figure 6:
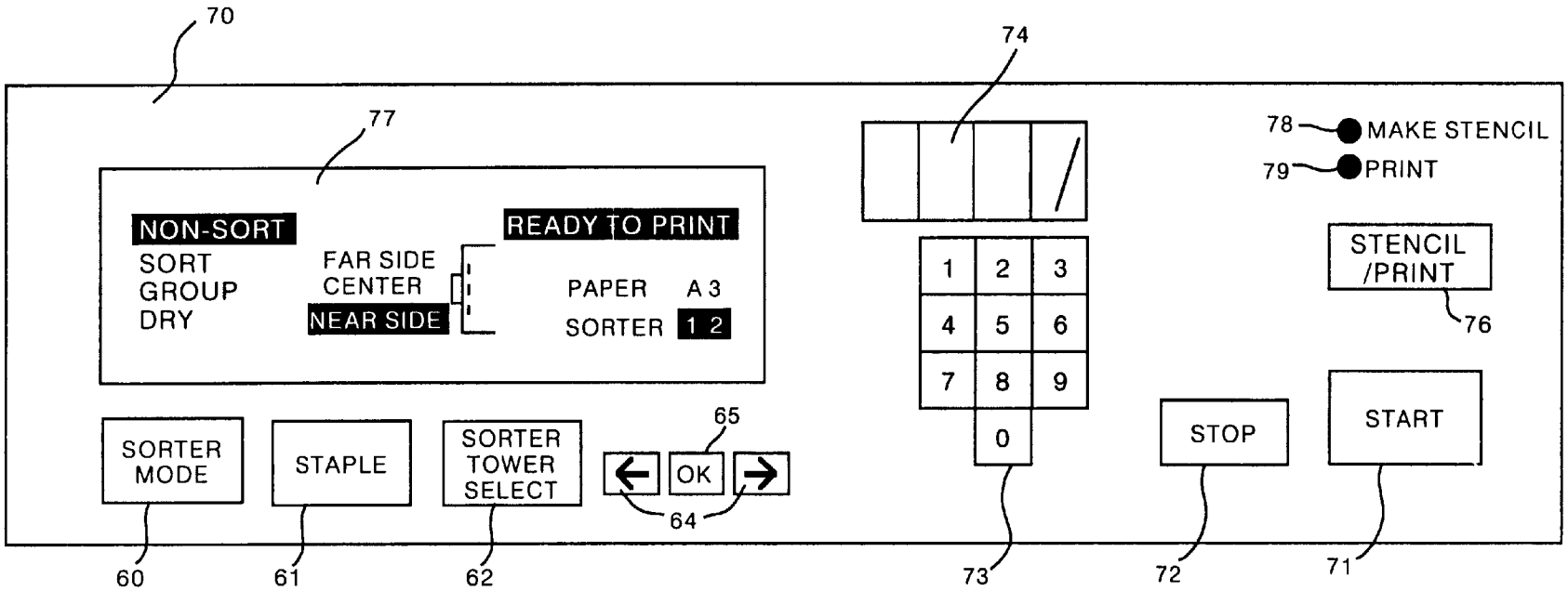
FIG. 6 is a diagram showing the operation panel section of the printer unit.

FIG. 6 is a diagram showing an operation panel 70 provided in the printer unit 1. The operation panel 70 comprises a ten-digit keypad 73, a copies LED indicator 74, a display 77 consisting of a liquid crystal panel or the like, a sorter mode button 60, a staple button 61, a sorter tower select button 62, cursor buttons 64, an OK button 65, a start button 71, a stop button 72, a stencil/print button 76, a stencil making mode LED 78, and a print mode LED 79.

The keypad 73 is composed of numerical keys 0 to 9 which are pressed to enter settings such as the number of copies to be printed.

The copies LED indicator 74 displays the number of copies to be printed entered using the ten-digit keypad 73. The number displayed by the LED indicator 74 decreases from the set value by one synchronously with the discharge of each printed sheet P during the printing operation of the printer unit 1.

The display 77 displays error messages when a malfunction such as a paper jam occurs and also displays the size of the printing paper P' loaded in the sheet feeder tray 473. The display 77 further displays selection for use of the first sorter 2 connected to the printer unit 1, the set condition of the auto-stapler, the operating state of the first and second sorters 2, 3, and pertinent error messages when problems arise. Other information displayed by the display 77 includes the operating state of the printer unit 1, the state of the sorter 2 use mode, the operating state of the stencil printer 1, the selected sorter mode, and the staple mode. The sorter mode and the staple mode displayed in reverse video are the ones currently in effect.

The sorter mode button 60 is pressed to select one mode from among the non-sort mode for depositing the printed sheets P in the non-sort output tray 483 and the three modes for storing the printed sheets P using the sorters 2, 3 (i.e., the sort mode, group mode and dry mode). When the sorter mode button 60 is repeatedly pressed after power-on, the selected mode circulates among the non-sort mode, sort mode, group mode, dry mode and non-sort mode in the order mentioned. In the non-sort mode, the printed sheets P discharged from the paper output port of the printer unit 1 are fed directly into the non-sort output tray 483.

In the sort mode, the printed sheets P discharged from the paper output port of the printer unit 1 are successively sorted by page into the bins to be collated into multipage documents, pamphlets, books or the like.

In group mode, the printed sheets P discharged from the paper output port of the printer unit 1 are sorted into groups and stored in bins to carry out multiple sorting by document of (sheets×groups).

In dry mode, which is for reducing the amount of transfer printing to the backs of the overlaid sheets, the process of sequentially distributing the printed sheets P discharged from the paper output port of the printer unit 1 into the bins one by one is repeated until the total number of copies has been printed.

The staple button 61 is pressed to conduct auto-stapling. In auto-stapling, as explained further later, the stapler 34 is used to staple the printed sheets P after they have been sorted into the bins and aligned. Repeatedly pressing the staple button 61 after power-on circulates the selected mode among near-single mode, center-double mode, far-single mode, and stapling OFF mode.

The sorter tower select button 62 is used to select between use and nonuse of each of multiple sorter units.

The cursor buttons 64 are used to move the cursor in the selected screen displayed on the display 77.

The OK button 65 is used to accept items selected using the cursor buttons 64.

The start button 71 is pressed to start the operation of the printer unit 1 and the sorters 2, 3.

The stop button 72 is pressed to stop the operation of printer unit 1 and the sorters 2, 3.

The stencil/print button 76 is pressed to switch between stencil making operation and printing operation. The LEDs 78 and 79 are provided above the stencil/print button 76 to indicate which of the stencil making and printing modes is in effect.

The liquid crystal screen of the display 77 displays both the operating state of the printer unit 1 and numerals indicating the first sorter 2 and the second sorter 3 connected to the printer unit 1. These numerals are displayed in reverse video to indicate that the corresponding sorter can be used. The sorter use modes and the set operation of the stapler 34 are also displayed.

Control Circuit

The control circuit of the present embodiment will now be explained.

Figure 7:
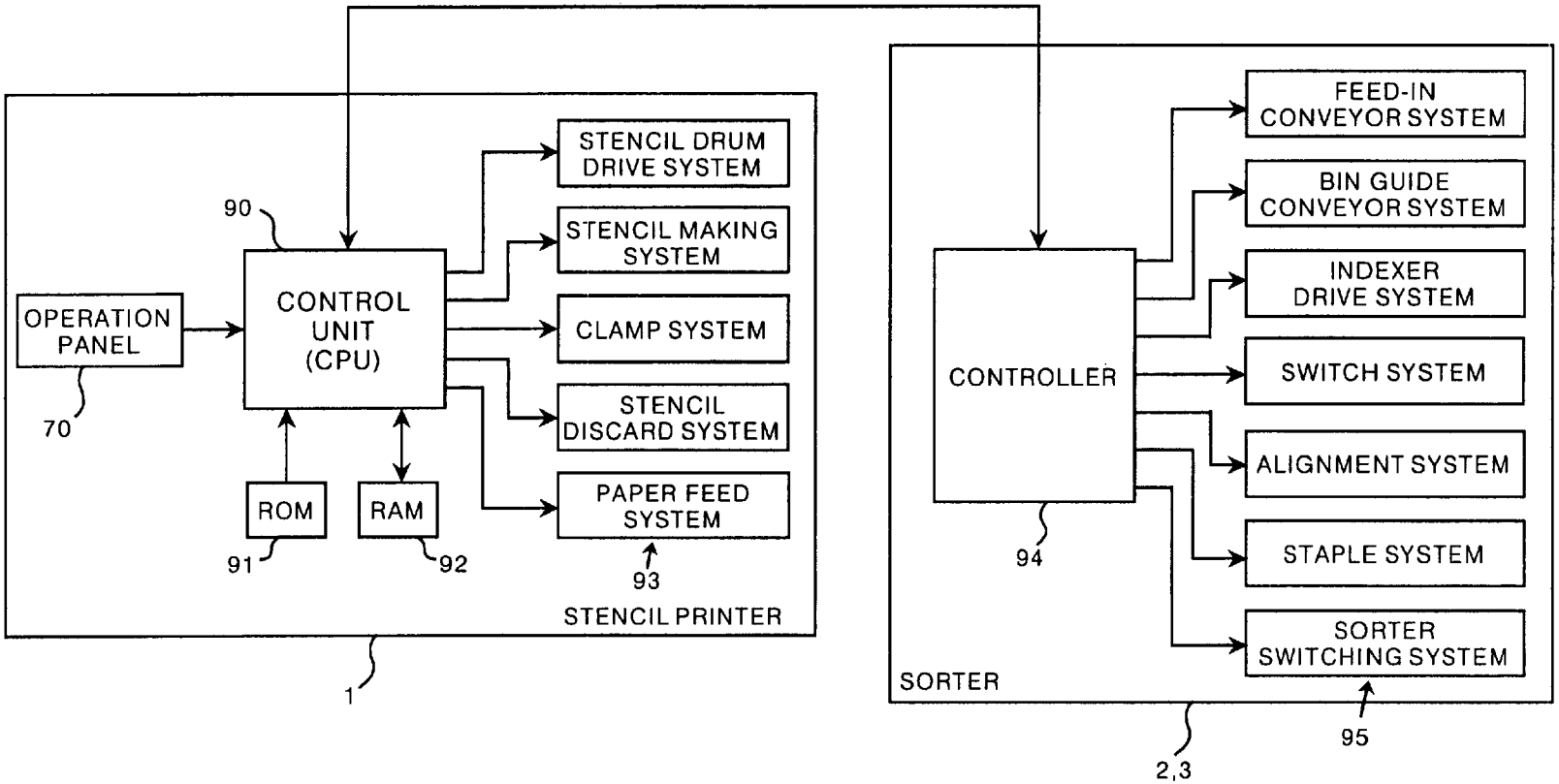
FIG. 7 is a block diagram of a control circuit.

FIG. 7 is a block diagram showing the configuration of the control circuit of the present embodiment. As shown in FIG. 7, the control circuit comprises a printer unit system group 93 responsive to instructions from the operation panel 70 and including a stencil drum drive system, a stencil making system, a clamp system, a stencil discard system and a paper feed system, and further comprises a controller 94 for driving the sorters 2, 3, a ROM 91 for storing a program and setting data, and a CPU 90 for controlling the controller 94 based on the program and setting data stored in the ROM 91. The controller 94 of the sorter 2 is responsive to commands from the CPU 90 for driving a system group 95 of the sorters 2, 3 that includes a feed-in conveyor system, a bin guide conveyor system, an indexer drive system, a switch system, an alignment system, a staple system, and a sorter switch system. A RAM 92 is provided in association with the CPU 90 for storing the number of copies to be printed, the sorter mode and other settings, whenever they are input through the operation panel 70.

Control Program

The operation of the present embodiment will now be explained. To simplify the explanation, the present embodiment is defined as having a row of bins 21 consisting of 20 bins and will be explained with regard to the sort mode conducted using the first and second sorters 2 and 3 for the purpose of collation and stapling.

When the system is in the standby mode, the display 77 shown in FIG. 6 displays the operating state of the printer unit 1, the selected sorter mode, the staple mode, the size of the paper loaded in the sheet feeder tray 473, and the numerals representing the connected first sorter 2 and second sorter 3. The sorter mode and the staple mode displayed in reverse video are the ones currently in effect.

From Standby to Completion of Operation

Figure 8:
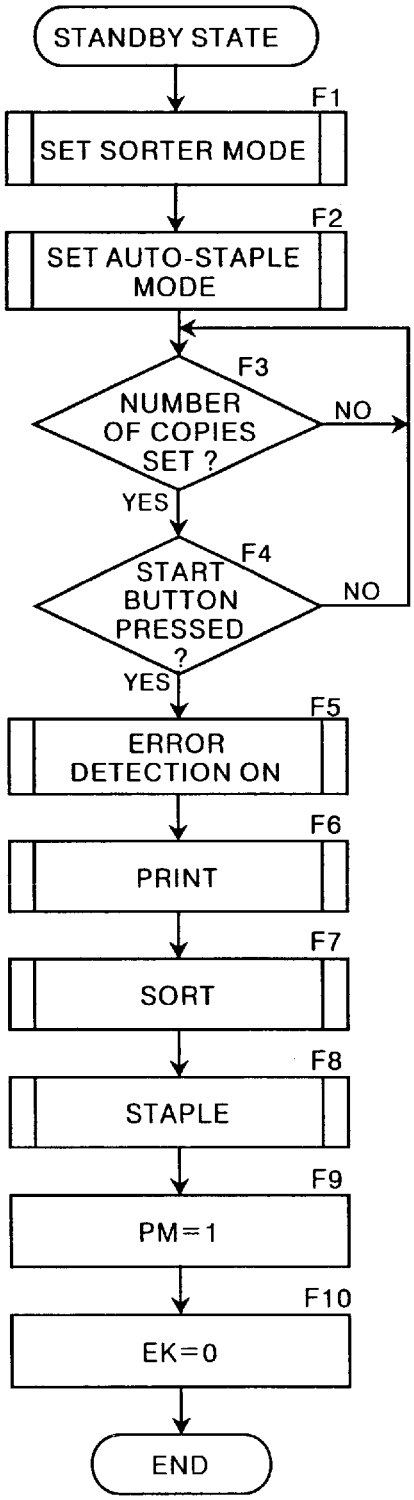
FIG. 8 is a flowchart showing the flow of processing between standby and the completion of print/sort operation.

FIG. 8 is a flowchart showing the flow of processing between standby and the completion of print/sort operation in the auto-staple mode. The operator first sets the operating mode of the sorter in step F1 by pressing the sorter mode button 60 of the operation panel 70 (FIG. 6) and then sets auto-staple mode in step F2 by pressing the staple button 61 of the operation panel 70. Next, in step F3, it is checked whether the number of copies to be printed has been set by use of the ten-digit keypad 73. When the result in step F3 is YES, control passes to step F4 in which it is checked whether the start button 71 was pressed. When the result in step F4 is YES, control passes to step F5, in which error detection processing is started, and to steps F6 and F7, in which print operation and sort operation are commenced. The print operation (F6) is conducted by effecting the print processing of the printer unit 1 synchronously with the after-processing of the sorters 2 and 3.

When print/sort operation is initiated, the CPU 90 issues a command causing the print operation of the printer unit 1 in step F6 and the sort operation of the first sorter 2 and the second sorter 3 in step F7 to be effected simultaneously. When print/sort of multiple originals is conducted, the print operation and the sort operation are repeated as many times as there are originals. When these operations are completed, stapling operation is effected in step F8. Then, in step F9, the number of the sorter mode in effect when the printed sheets were discharged from the printer unit 1 is stored in a register PM. PM=0 designates no paper or non-sort mode, PM=1 designates sort mode, PM=2 designates group mode, and PM=3 designates dry mode. The default value of register PM set at power-on is zero. PM is also set to "0" if no paper is present in the sorters when sort mode is in effect, when printing is effected in non-sort mode, and when printing in sort mode, group mode or dry mode is completed and the printed sheets are removed before the subsequent sorter mode is set. Next, in step F10, "0" is written in a register EK. The value written in register EK is used in the error detection processing subroutine of step F5. Writing EK=0 terminates the error detection processing.

Setting Sorter Mode

Figure 9:
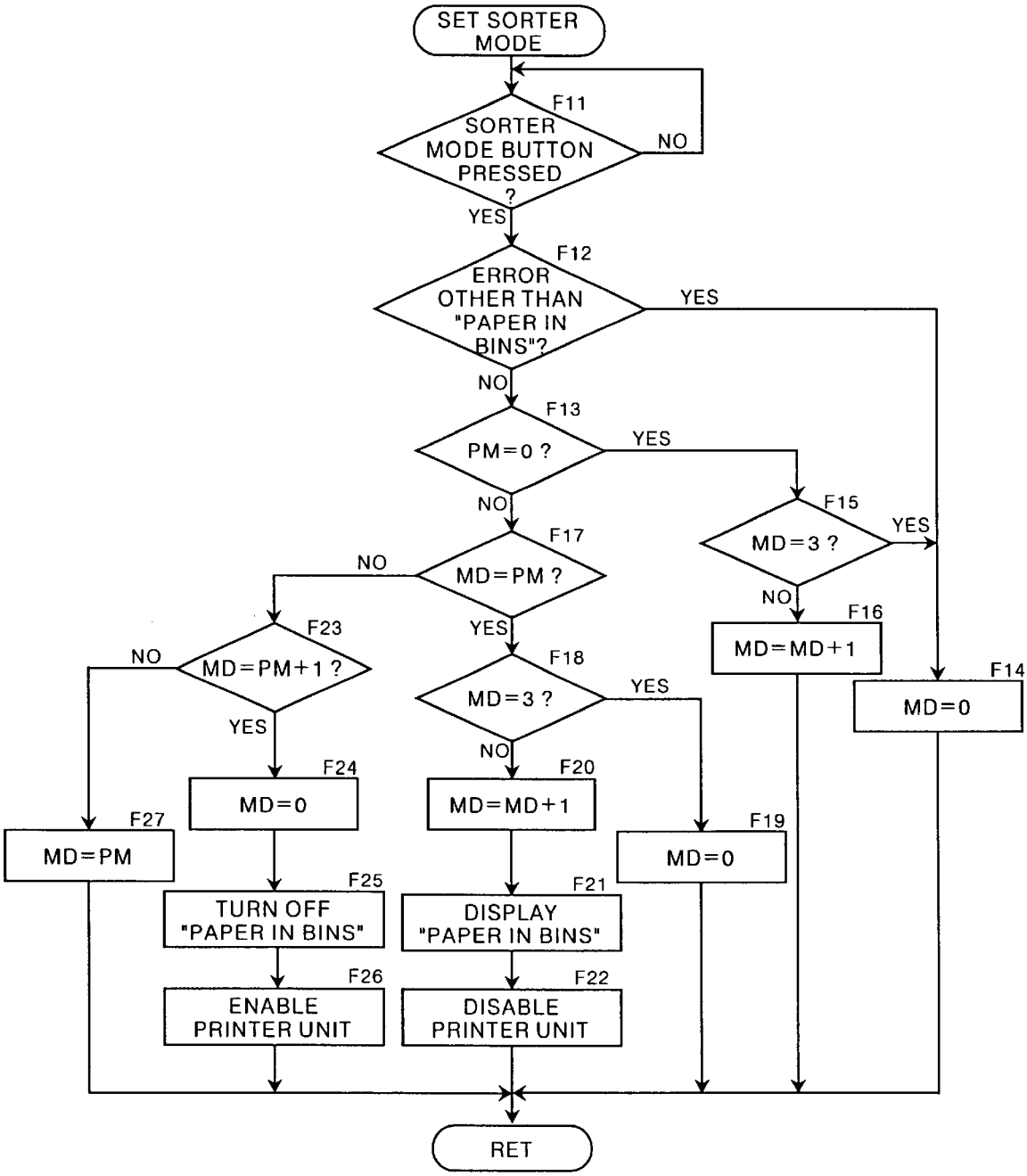
FIG. 9 is a flowchart showing the flow of processing for setting sorter mode.

FIG. 9 is a flowchart showing the flow of processing for setting the sorter mode when the system is idle (in standby mode).

The sorter mode in which the sorters are set is stored in a register MD. MD=0 designates non-sort mode, MD=1 designates sort mode, MD=2 designates group mode, and MD=3 designates dry mode. The default value of register MD set at power-on is zero.

First, in step F11, it is checked whether the sorter mode button 60 was pressed. When the result is YES, it is checked in step F12 whether an error other than "Paper in bins" error has occurred on the sorter side. When an error other than "Paper in bins" error has occurred on the sorter side, register MD is rewritten to MD=0 (non-sort mode) in step F14. Thus when a sorter has experienced an error other than "Paper in bins" error, the non-sort mode is automatically selected notwithstanding that an operating mode that uses the sorters was selected. This eliminates the need to reset the sorter mode.

When the result in step F12 is YES, i.e., when no error other than "Paper in bins" error has occurred on the sorter side, control passes to step F13, in which it is checked whether the value of register PM is "0" and thereby discriminate whether or not printed sheets P remain in the sorters. When the result is YES, meaning that no printed sheets P remain in the sorters, control passes to step F15, in which it is checked whether the value of register MD before the sorter mode button 60 was pressed was 3 (dry mode). When the result is NO, the value of register MD is incremented by 1 in F16 to advance the mode by one. When the result in F15 is YES, meaning that the value of register MD before the sorter mode button 60 was pressed was 3, register MD is rewritten to "0" in step F14 to return to the non-sort mode.

On the other hand, when the result in step F13 is NO, meaning that printed sheets remain in the sorters, control passes to step F17, in which it is checked whether the sorter mode before the sorter mode button 60 was pressed (register MD value) and the mode when the printed sheets were discharged from the printer unit 1 (value of register PM) are the same. When the register MD value and the register PM value are equal, control passes to step F18, in which it is checked whether MD=3 (dry mode). When the result is YES, control passes to step F19, in which a switch from dry mode to non-sort mode (MD=0) is effected. When the result in step F18 is NO, the value of register MD is incremented by 1 in step F20, "Paper in bins" error is displayed in step F21, and operation of the printer unit 1 is disabled in step F22.

Step F22 can be omitted or can be defined to display or sound an alarm rather than disable the printer unit 1.

When the register MD value and the register PM value are found to be different in step F17, control passes to step F23, in which it is checked whether the sorter mode before the sorter mode button 60 was pressed (register MD value) is equal to the mode when the printed sheets were discharged from the printer unit 1 plus 1. A YES result in step F23 means a "Paper in bins" error has occurred. When the sorter mode button 60 is pressed under such circumstances, therefore, MD is set to "0" in step F24 to make the sorter mode non-sort mode, irrespective of the value of register MD, the "Paper in bins" error is cleared in step F25, and the printer unit 1 is re-enabled in step F26. A NO result in step F23 means that the non-sort mode is set with paper present in the bins. In this case, control passes to step F27, in which the sorter mode is changed to the mode at the time the printed sheets P were sorted into the bins.

The control set out in the foregoing prevents printed sheets sorted in a later selected mode from getting mixed in with paper sheets already present in the bins that were sorted in another mode. At the time point when a "Paper in bins" error arises, moreover, the non-sort mode is set, skipping the other modes, because the occurrence of this error means that modes other than the non-sort mode and the mode in which the sheets in the bins were sorted cannot be used. This enables the sorter mode to be promptly switched without displaying the unusable modes.

Sorter Tower Selection

Figure 10:
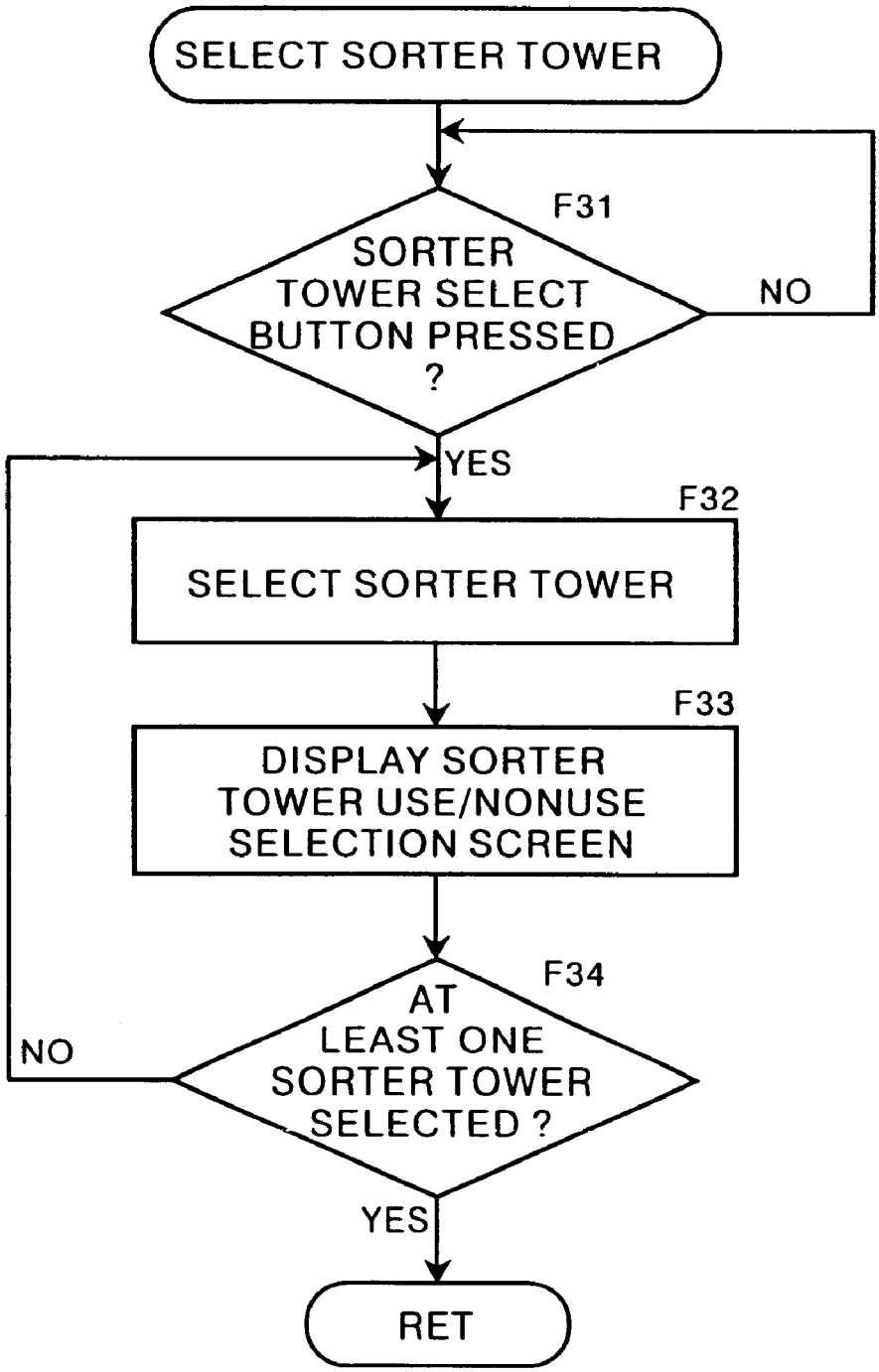
FIG. 10 is a flowchart showing the flow of processing for sorter tower selection

FIG. 10 is a flowchart of a subroutine for sorter tower selection.

When it is found in step F31 that the sorter tower select button 62 was pressed, a sorter tower select screen such as shown in FIG. 11 is displayed in step F32. At this point the operator selects one or more sorter tower numbers to be set by using the cursor buttons 64 and pressing the OK button 65. Control then passes to step F33, in which a screen such as shown in FIG. 12 is displayed for enabling the operator to set whether or not the selected sorter tower or towers are to be used. The operator then uses the cursor buttons 64 to select Yes or No and then presses the OK button 65. Next, in step F34, it is checked whether at least one sorter tower has been selected. When the result in step F34 is NO, control returns to step F32 to restart sorter tower selection, and when it is YES, the subroutine is terminated.

Error Detection

Figure 13:
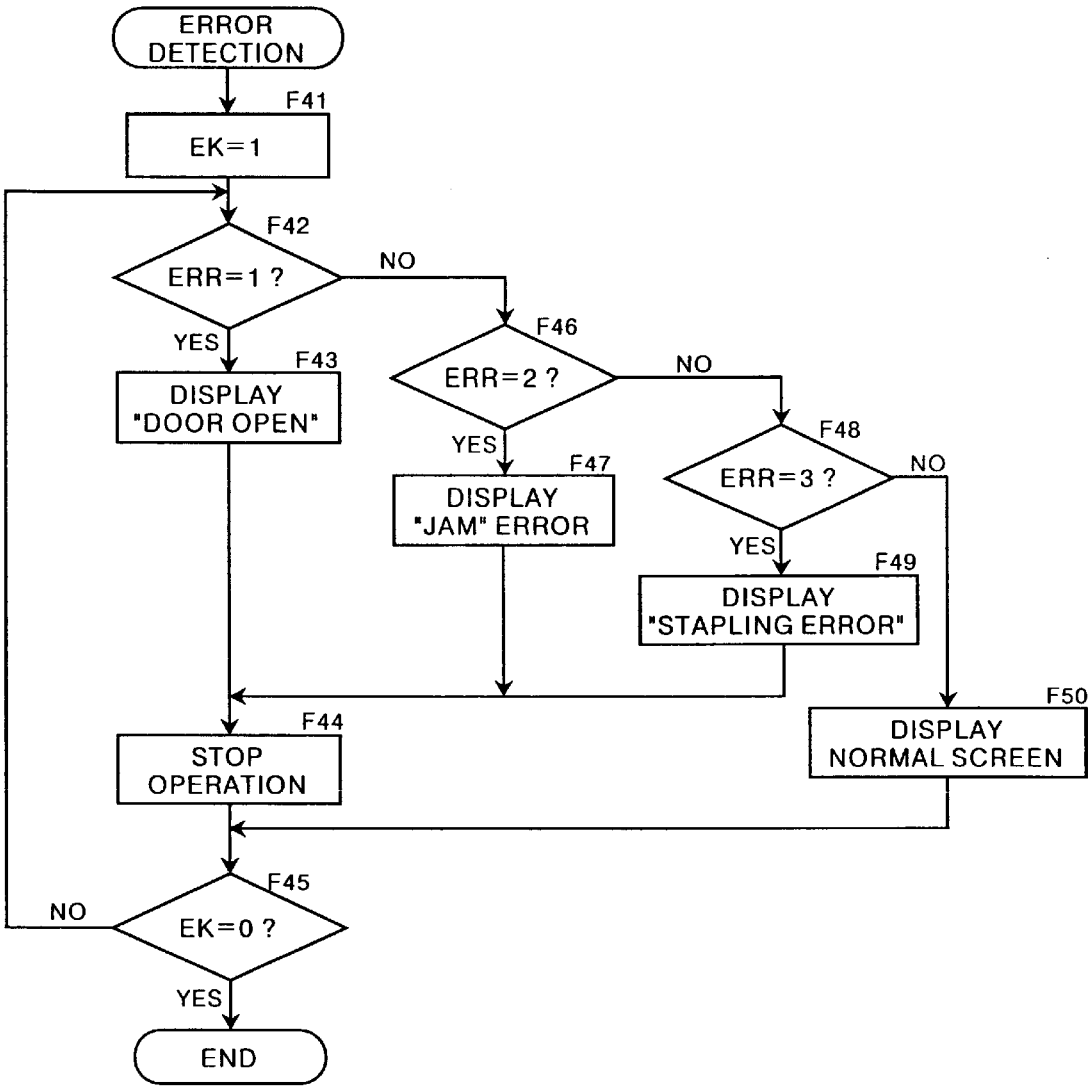
FIG. 13 is a flowchart showing the flow of processing for error detection.

FIG. 13 is a flowchart of an interrupt subroutine for error detection processing that is activated in step F5 and terminated in step F10 of FIG. 8. The error detection processing begins at the time of an affirmative finding in step F4 in FIG. 8, i.e., at the time the start button 71 is pressed, and initially sets the error detection register EK to "1" in step F41. The types of errors are written in an error register ERR. ERR=1 designates a door open error, ERR=2 designates a jam error, and ERR=3 designates a stapling error. In the following step F42, it is checked whether the value in error register ERR is "1." When it is, control passes to step F43, in which a door open error is displayed, to step F44, in which sorter operation is stopped, and to step F45, in which it is checked whether EK=0. When the result in step F45 is NO, control returns to step F42. Steps F42 to F45 are repeated until EK=0 is determined, at which time the error detection processing is terminated.

When the result in step F42 is NO, control passes to step F46, in which it is checked whether error register ERR value is 2. When the result is YES, a jam error is displayed in step F47 and control passes to step F44. When the result in step F46 is also NO, control passes to step F48, in which it is checked whether the error register ERR value is 3. When the result is YES, a stapling error is displayed in step F49 and control is passed to step F44. When the result in step F48 is also NO, a normal screen is displayed in step F50 and control is passed to step F45.

Flow of Sort Operation

Figure 14:
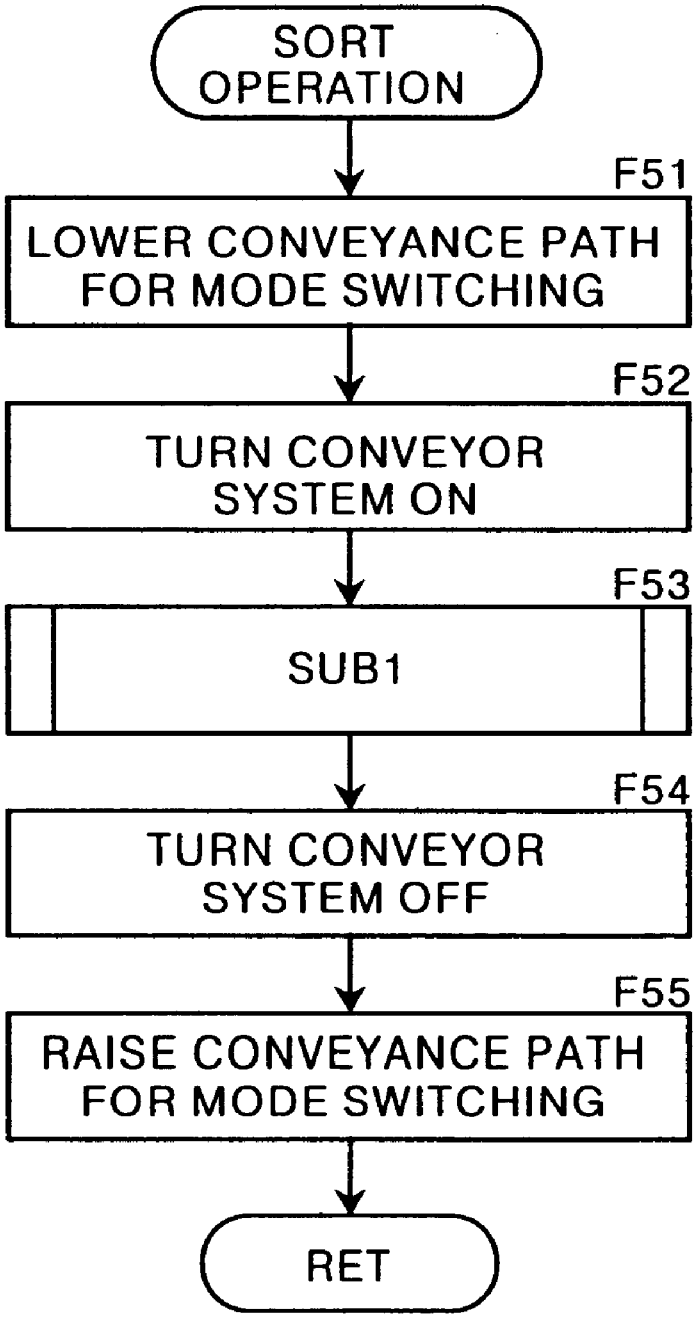
FIG. 14 is a flowchart showing the flow of processing for sort operation.
Figure 15:
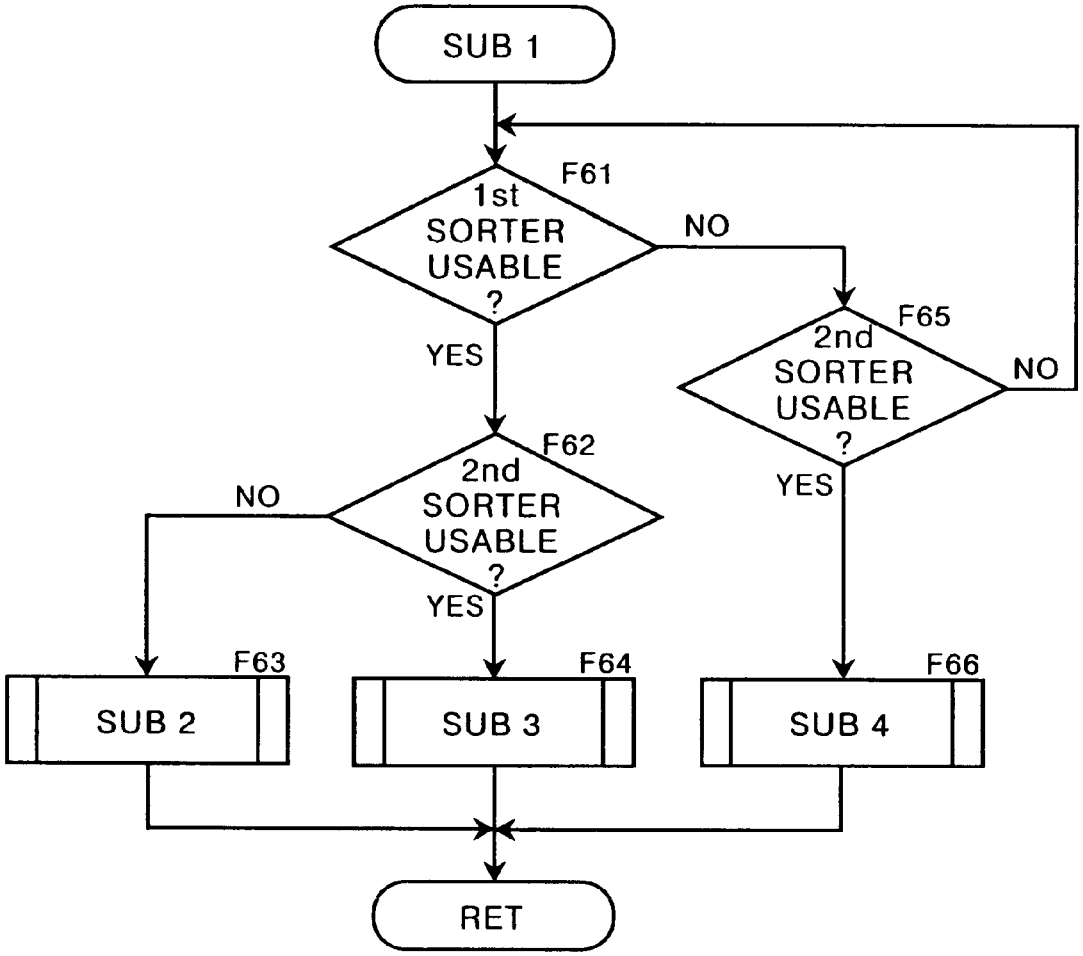
FIG. 15 is a flowchart showing subroutine 1 (SUB1) in the flowchart of FIG. 14.

FIG. 14 is a flowchart of a subroutine showing the flow of sort operation processing in step F7 of FIG. 8. Upon the commencement of sort operation, first, in step F51, a DC motor is operated to lower the conveyance path 31 for mode switching (FIG. 4), thereby switching the conveyance path so as to convey the printed sheets P to the first sorter 2 and the second sorter 3. Next, in step F52, conveyance of the printed sheets P to the sorters 2, 3 is enabled by turning on the DC motors for operating the conveyor belts 24, 25 and 42 and turning on the suction fans 28, 29 and 43. With the system in this state, control passes to step F53, in which subroutine 1 (SUB1) shown FIG. 15 is executed to insert the printed sheets P into the bins. Then, when insertion of all printed sheets P has been completed, control passes to step F54, in which the conveyor belts 24, 25 and 42 and the suction fans 28, 29, 43 are turned off, and to step F55, in which the conveyance path 31 for mode switching is raised. This completes the sort operation.

Figure 16:
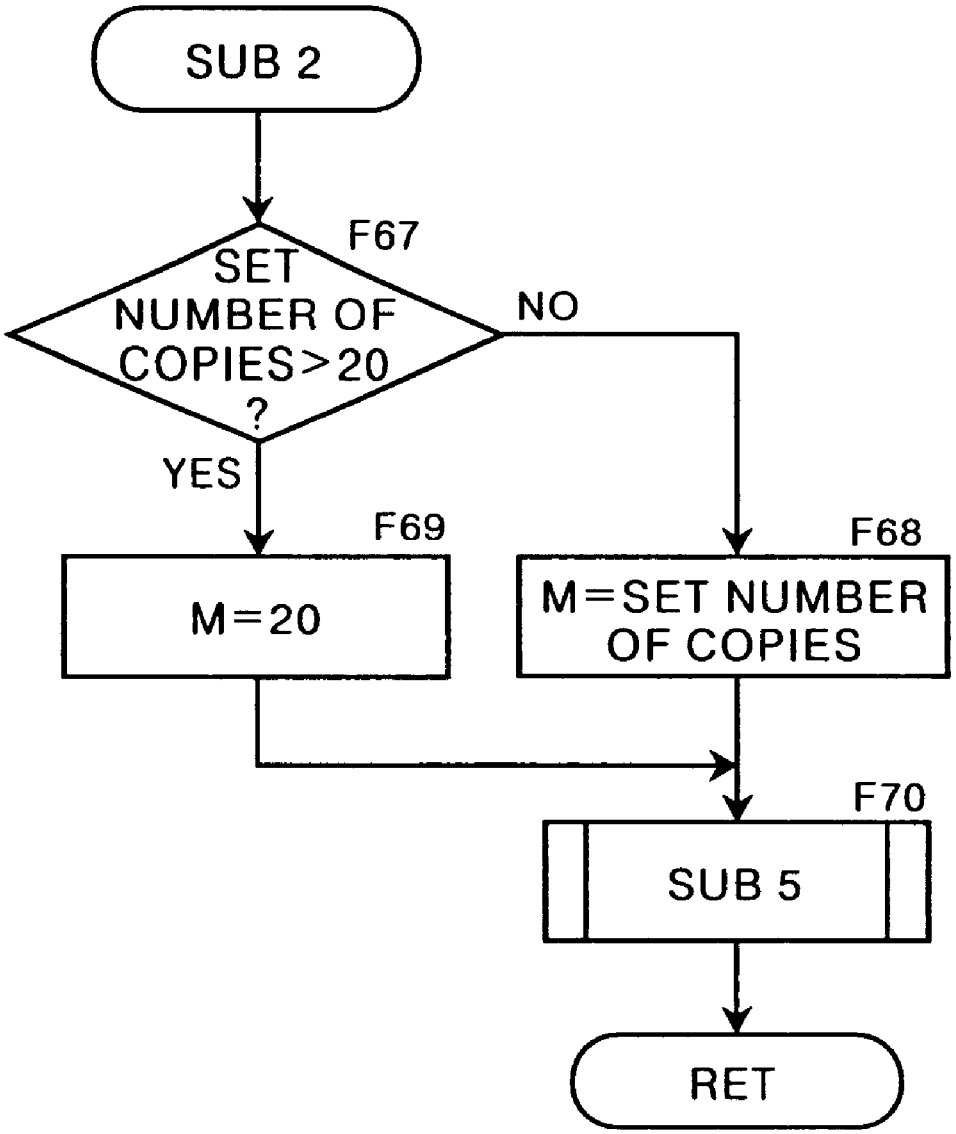
FIG. 16 is a flowchart showing subroutine 2 (SUB2) in the flowchart of FIG. 15.
Figure 17:
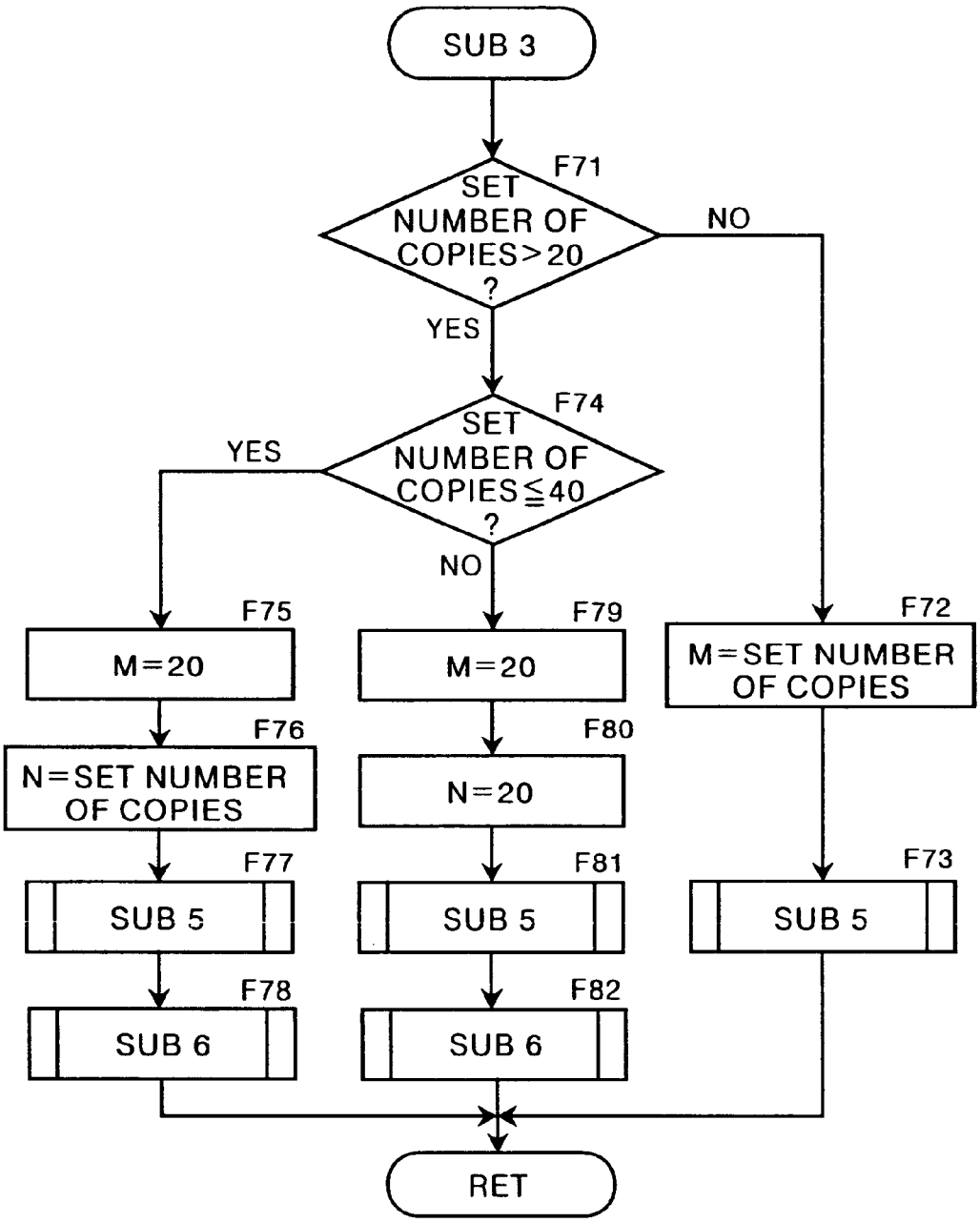
FIG. 17 is a flowchart showing subroutine 3 (SUB3) in the flowchart of FIG. 15.

FIG. 15 is a flowchart of subroutine 1 (SUB1) executed in step F53 of FIG. 14. First, in step F61, it is checked whether the first sorter 2 is set to be usable. When it is, it is checked in step F62 whether the second sorter 3 is set to be usable. When the first sorter 2 is usable and the second sorter 3 is unusable, subroutine 2 (SUB2) shown in FIG. 16 is executed in step F63. When both the first sorter 2 and the second sorter 3 are usable, subroutine 3 (SUB3) shown in FIG. 17 is executed in step F64. When the first sorter 2 is found to be unusable in step F61 and the second sorter 3 is found to be usable in step F65, subroutine 4 (SUB4) is executed in step F66.

FIG. 16 is a flowchart of subroutine 2 (SUB2) executed in step F63 of FIG. 15. First, in step F67, the set number of copies to be printed is compared with the number of bins

Figure 19:
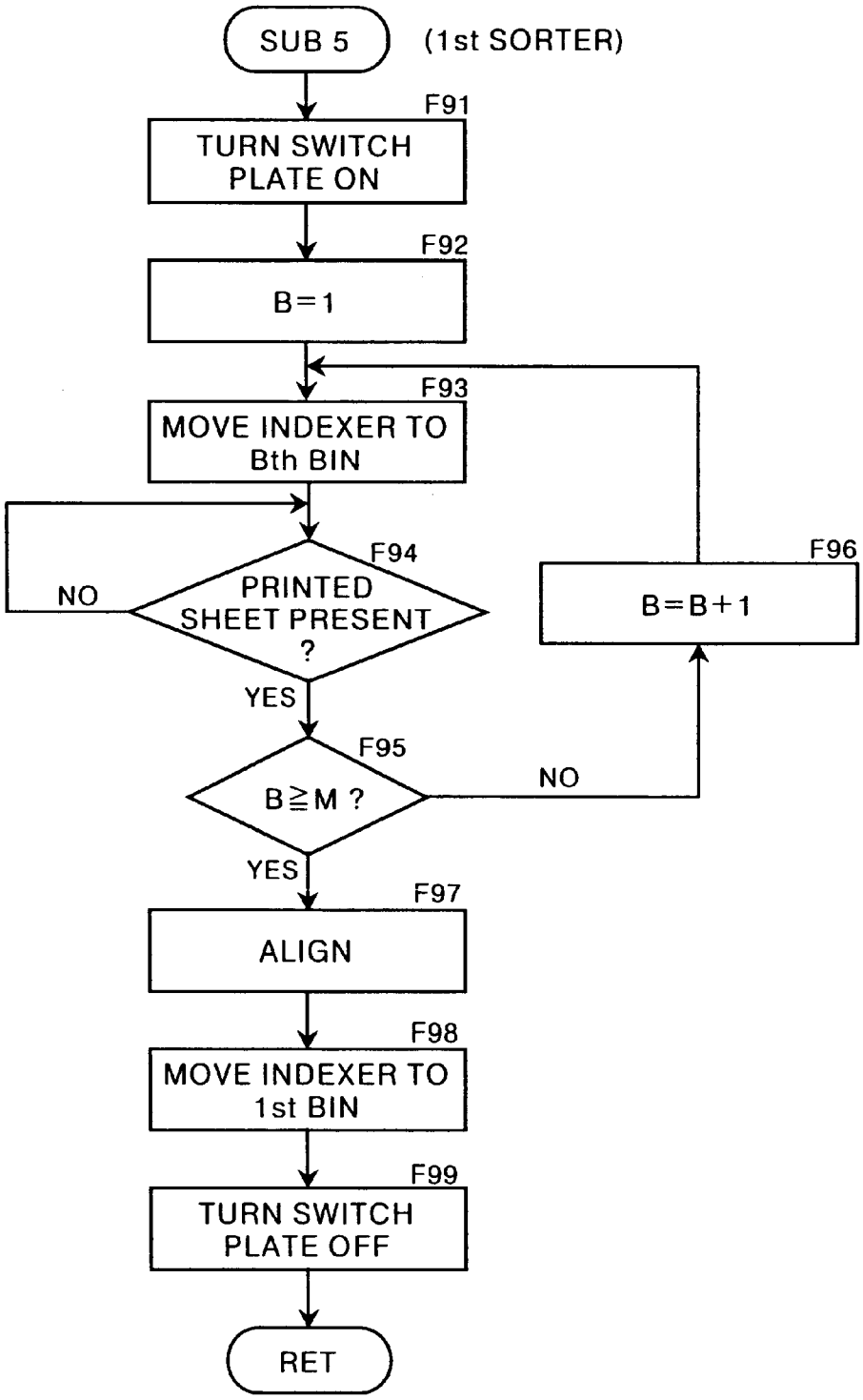
FIG. 19 is a flowchart showing subroutine 5 (SUB5) in the flowcharts of FIGS. 16 and 17.

(20) of the first sorter 2. When the set number is equal to or less than the number of bins, the set value is written to a register M in step F68. When it is greater, the number of bins (20) is written to register M in step F69. Following step F68 or F69, subroutine 5 (SUB5) shown in FIG. 19 is activated in step F70 and subroutine 2 is terminated. The value written to register M is used in subroutine 5.

Figure 20:
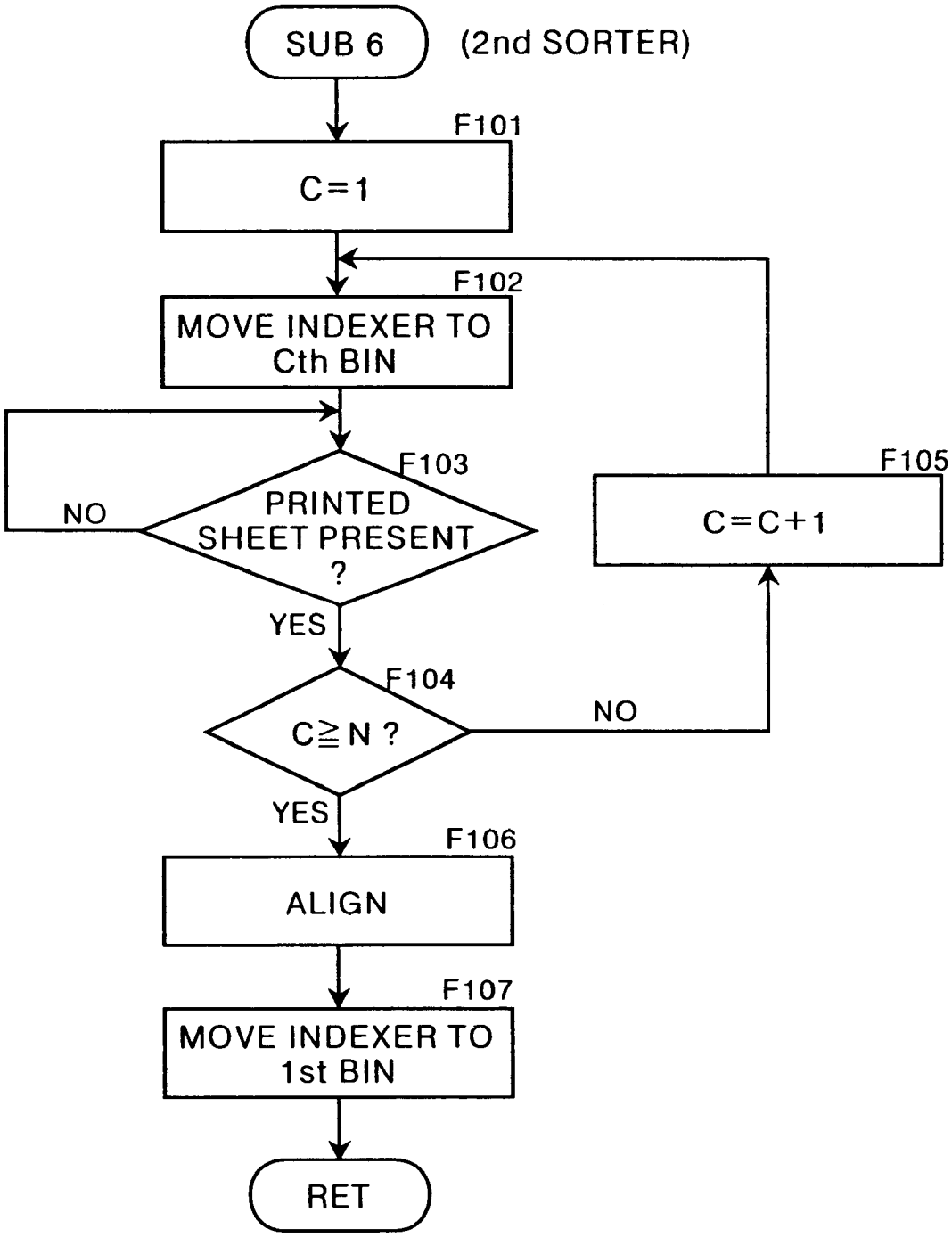
FIG. 20 is a flowchart showing subroutine 6 (SUB6) in the flowcharts of FIGS. 17 and 18.

FIG. 17 is a flowchart of subroutine 3 (SUB3) executed in step F64 of FIG. 15. First, in step F71, the set number of copies to be printed is compared with the number of bins (20) of the first sorter 2. When the set number is equal to or less than the number of bins, the set value is written to register M in step F72 and subroutine 5 (SUB5) shown in FIG. 19 is activated in step F73, whereafter subroutine 3 is terminated. When the set number is found to be equal to or less than the number of bins in step F71 and found to be equal to or less than the total number of bins of the first sorter 2 and the second sorter 3 in step F74, the number of bins (20) is written to register M in step F75, the difference obtained by subtracting the number of bins of the first sorter 2 from the set number is written to in step F76, subroutine 5 (SUB5) shown in FIG. 19 is activated in step F77, and subroutine 6 (SUB6) shown in FIG. 20 is activated in step F78, whereafter subroutine 3 is terminated.

When it is found in step F74 that the set number is greater than the total number of bins of the first sorter 2 and the second sorter 3, the number of bins of the first sorter 2 is written to register M in step F79, the number of bins of the second sorter 3 is written to register N in step F80, subroutine 5 (SUB5) is activated in step F81, and subroutine 6 (SUB6) is activated in step F82, whereafter subroutine 3 is terminated. The value written to register N is used in subroutine 6.

Figure 18:
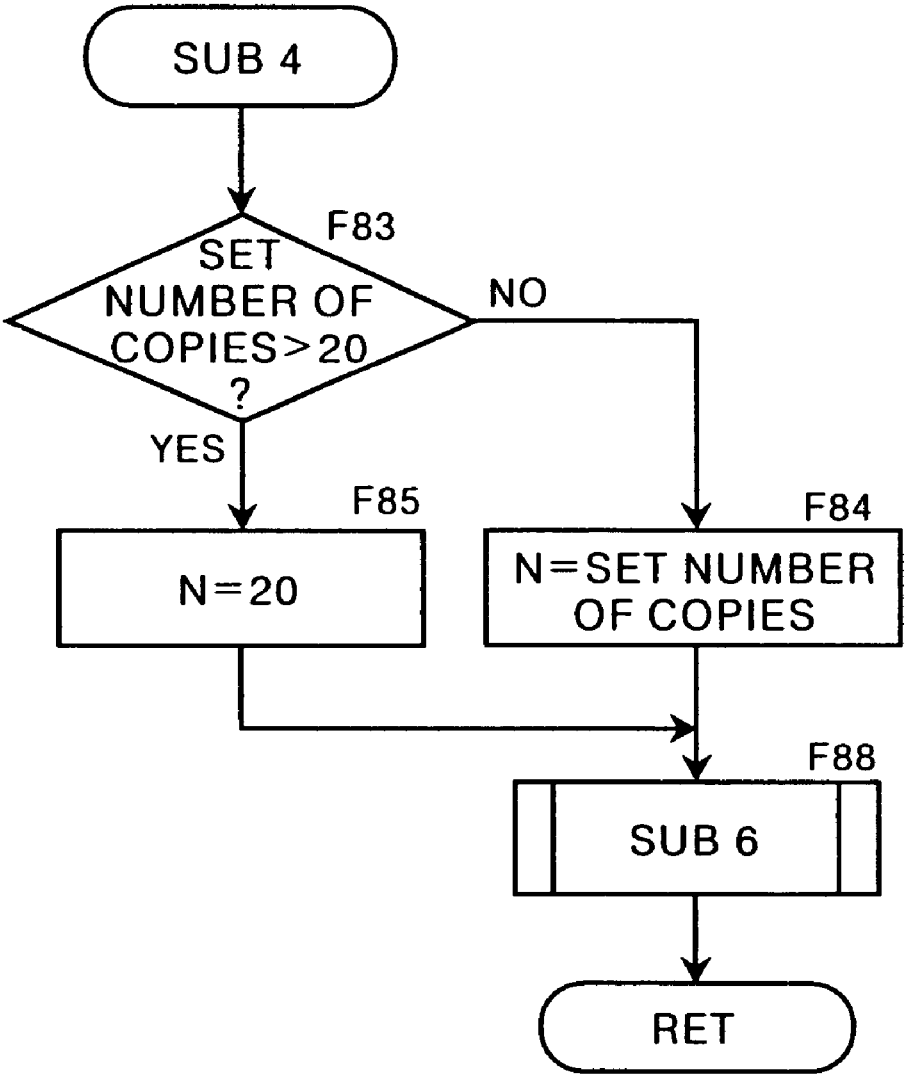
FIG. 18 is a flowchart showing subroutine 4 (SUB4) in the flowchart of FIG. 15.

FIG. 18 is a flowchart of subroutine 4 (SUB4) executed in step F66 of FIG. 15. First, in step F83, the set number of copies to be printed is compared with the number of bins (20) of the second sorter 3. When the set number is equal to or less than the number of bins, the set value is written to register N in step F84. When it is greater, the number of bins (20) is written to register N in step F85. Following step F84 or F85, subroutine 6 (SUB6) shown in FIG. 20 is activated in step F86 and subroutine 4 is terminated.

FIG. 19 is a flowchart of subroutine 5 (SUB5) for controlling the first sorter 2. First, in step F91, a solenoid (not shown) is actuated to turn the sorter switch plate 41 ON so as to convey printed sheets P into the first sorter 2. When the sorter switch plate 41 is ON, it is in the position indicated by the solid line in FIG. 4. When it is OFF, it is in the position indicated by the broken line in FIG. 4. When the sorter switch plate 41 is OFF, sheets conveyed on the conveyor belt 25 are sent from the bend region onto the conveyor belt 42. Next, in step F92, the value of a register B is set to "1." Then, in step F93, a DC servo motor is operated to move the indexer 22 to the Bth bin. Since B=1 at this time, the indexer 22 goes to the 1st bin. Next, in step F94, the indexer sensor 23 is used to check whether a printed sheet P is present. When a printed sheet P is found, the value of register B is compared with the value of register M in step F95. When the value of register B is less than the value of register M, control passes to step F96, in which the value of register B is incremented by 1 and control is returned to step F93. When the value of register B becomes equal to the value of register M, control passes to step F97, in which alignment is effected. Next, in step F98, the indexer 22 is moved to the 1st bin. The sorter switch plate 41 is then turned off by the solenoid in step F99 and subroutine 5 is terminated.

FIG. 20 is a flowchart of subroutine 6 (SUB6) for controlling the second sorter 3. First, in step F101, the value of a register C is set to "1." Then, in step F102, a DC servo motor is operated to move the indexer of the second sorter 3 to the Cth bin. Since C=1 at this time, the indexer goes to the 1st bin. Next, in step F103, the indexer sensor of the second sorter 3 is used to check whether a printed sheet P is present. When a printed sheet P is found, the value of register C is compared with the value of register N in step F95. When the value of register C is less than the value of register N, control passes to step F105, in which the value of register C is incremented by 1 and control is returned to step F103. When the value of register C becomes equal to the value of register N, control passes to step F106, in which alignment is effected. Next, in step F107, the indexer is moved to the 1st bin and subroutine 6 is terminated.

Stapling Operation

Figure 21:
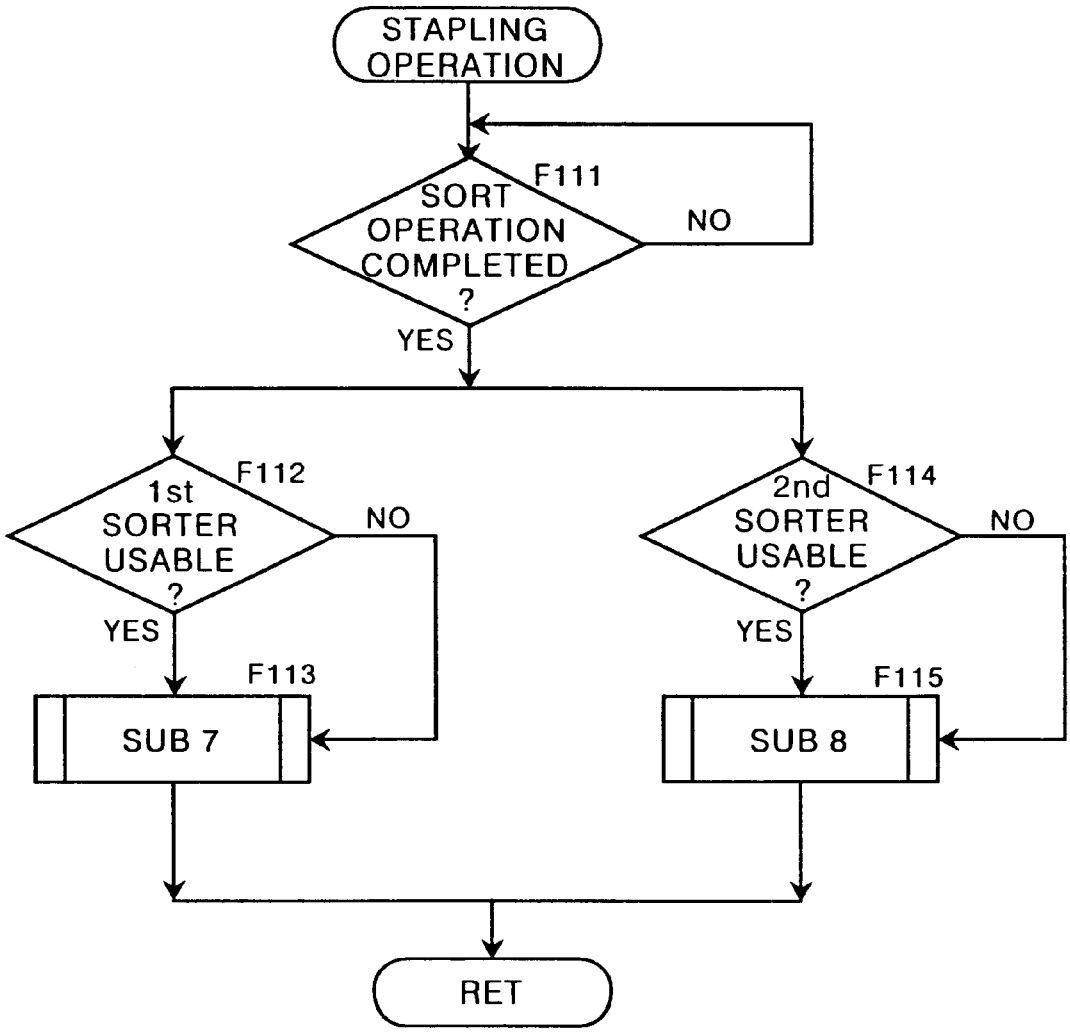
FIG. 21 is a flowchart of showing the flow of processing for stapling operation.

FIG. 21 is a flowchart showing the flow of stapling operation processing executed in step F8 of FIG. 8. First, when it is found in step F111 that the sort operation has been completed, control passes to steps F112 and F114, in which stapling operation is simultaneously effected by the staplers of all usable sorter towers. The stapling operation is effected by subroutine 7 (SUB7) in step F113 and subroutine 8 (SUB8) in step F115.

Figure 22:
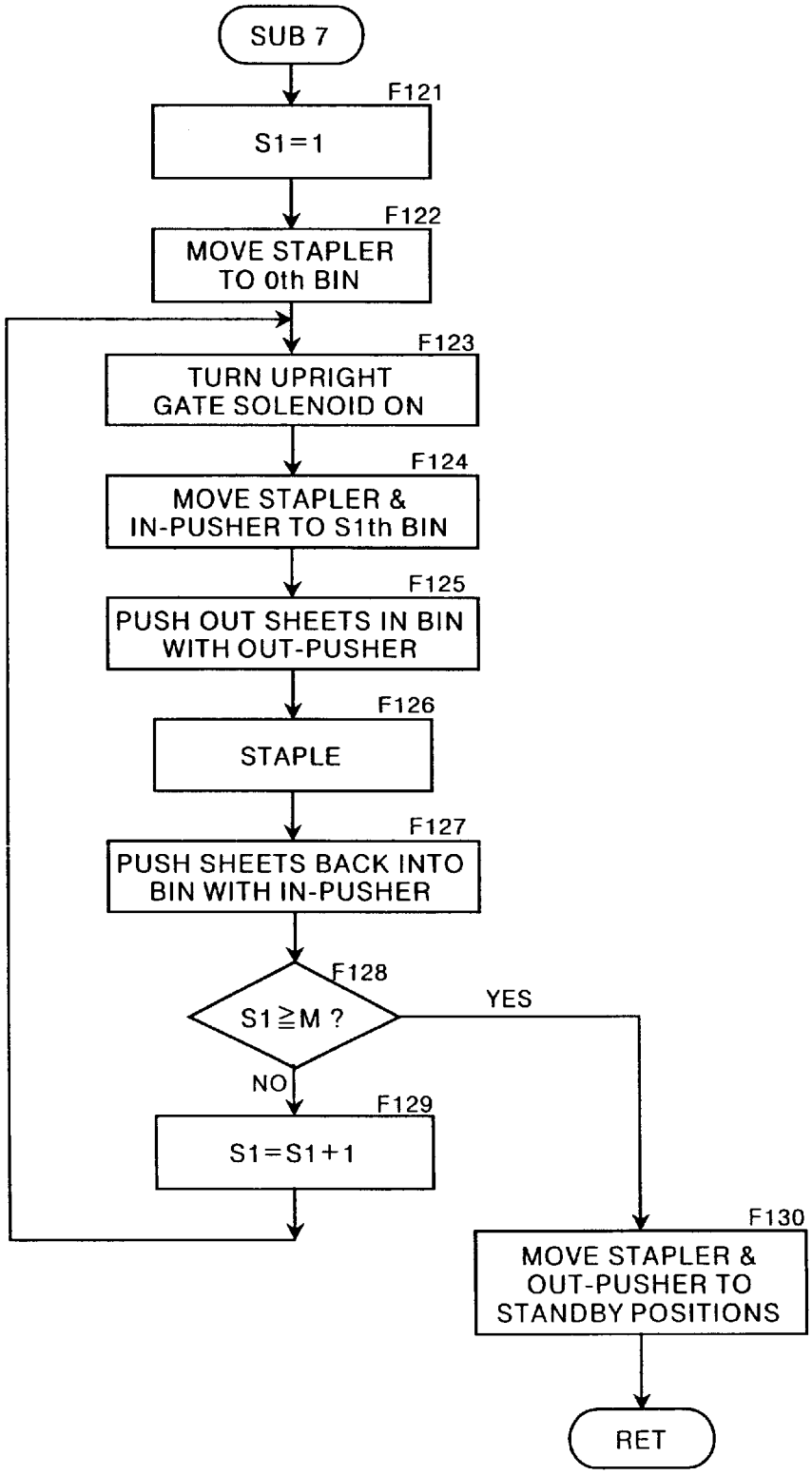
FIG. 22 is a flowchart showing subroutine 7 (SUB7) in the flowchart of FIG. 21.

FIG. 22 is a flowchart showing subroutine 7 (SUB7) for conducting stapling in the first sorter 2. First, in step F121, the value of a register S1 is set to "1." The value of register S1 designates the number of bins at which stapling was effected. Next, the stapler 34 is moved to the 0th bin position in step F122, the upright-gate-tilting solenoid 37 (FIG. 5) is turned ON in step F123, and the stapler 34 is moved to the 1st bin with the solenoid 37 kept ON in step F124. This operation pushes down the lever 38 and opens the upright gate 21*a* of the 1st bin. It also moves the out-pusher 53*a* of the alignment rod 53 to the 1st bin. Then, in step F125, the out-pusher 53*a* is operated to push the printed sheets P in the 1st bin toward the conveyor system side. Then, in step F126, the stapler 34 moves laterally to the stapling position and conducts stapling. The stapled printed sheets P projecting toward the conveyor system side are then pushed back into the bin by the in-pusher 36 in step F127. Next, in step F128, the value of register S1 and the value of register M are compared. When S1<M, control passes to step F129, in which the value of register S1 is incremented by 1 to effect stapling at the next bin and control is returned to step F123. When S1=M, meaning that the printed sheets P in all bins have been stapled, control passes to step F130, in which the stapler 34 and the out-pusher 53*a* are restored to their standby positions, and the stapling operation is terminated.

Figure 23:
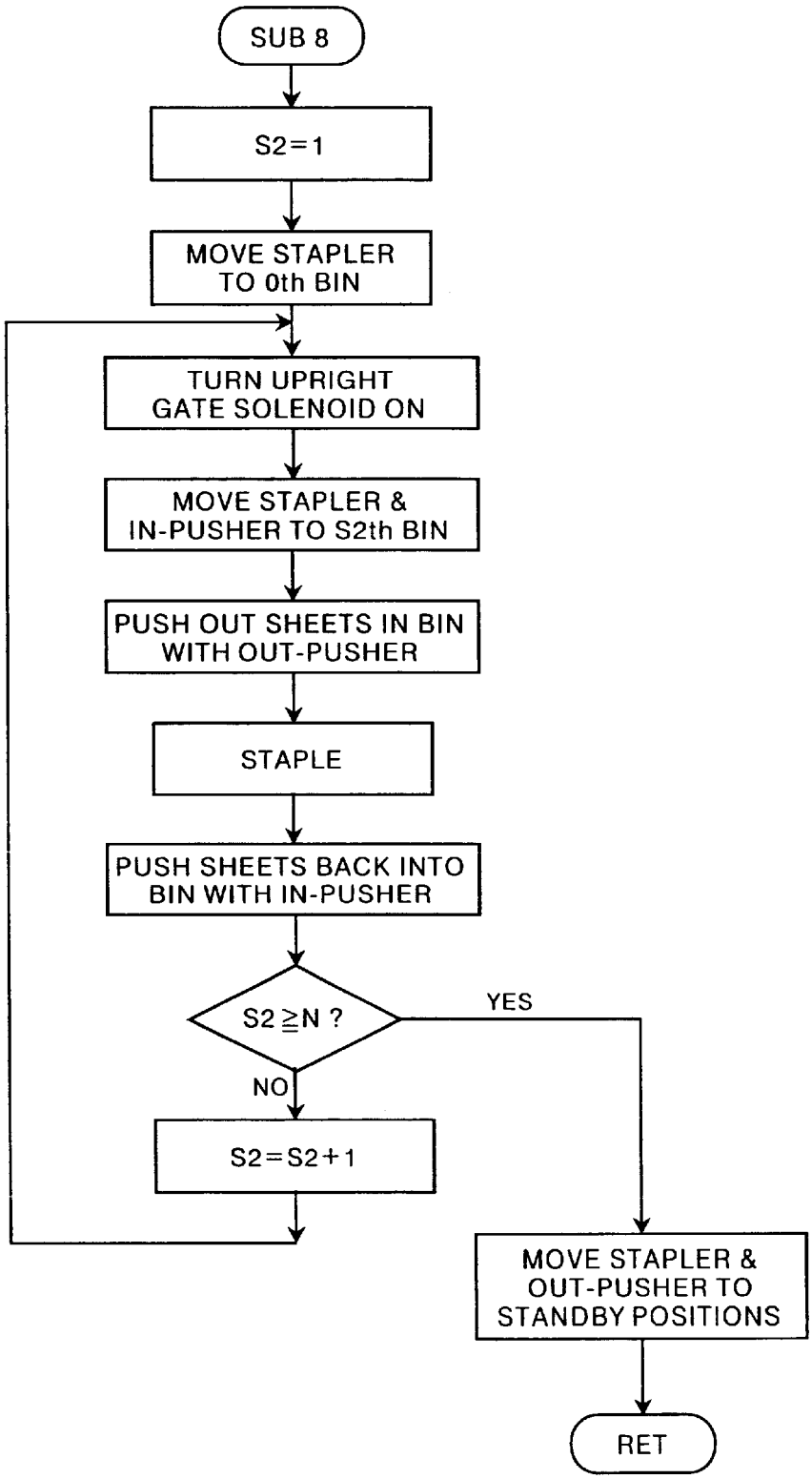
FIG. 23 is a flowchart showing subroutine 8 (SUB8) in the flowchart of FIG. 21.

FIG. 23 is a flowchart showing subroutine 8 (SUB8) for conducting stapling in the second sorter 3. Subroutine 8 is the same as subroutine 7 except that register registers S1 and M are changed to registers S2 and N. It will therefore not be explained in detail.

What is claimed is:

1. An image forming system comprising:

an image forming apparatus for forming desired images on sheets and discharging the image-formed sheets, a sheet after-processing apparatus connected to the image forming apparatus and capable of after-processing the image-formed sheets discharged from the image forming apparatus in any of multiple operating modes, mode selection means for selecting a sheet after-processing operating mode of the sheet after-processing apparatus, detection means for detecting presence of sheets stored in the sheet after-processing apparatus, and control means responsive to detection by the sheet detection means of presence in the sheet after-processing apparatus of sheets stored in a certain mode for disabling operation of the image forming apparatus when an operating mode using the sheet after-processing apparatus that is different from the certain mode is selected by the mode selection means.

2. An image forming system comprising:

an image forming apparatus for forming desired images on sheets and discharging the image-formed sheets, a sheet after-processing apparatus connected to the image forming apparatus and capable of after-processing the image-formed sheets discharged from the image forming apparatus in any of multiple operating modes, mode selection means for selecting a sheet after-processing operating mode of the sheet after-processing apparatus, detection means for detecting presence of sheets stored in the sheet after-processing apparatus, and notification means responsive to detection by the sheet detection means of presence in the sheet after-processing apparatus of sheets stored in a certain mode for issuing an error notice when an operating mode using the sheet after-processing apparatus that is different from the certain mode is selected by the mode selection means.

3. An image forming system according to claim 1 or 2, further comprising an abnormality detection means for detecting abnormality of the sheet after-processing apparatus and wherein automatic selection of an operating mode not using the sheet after-processing apparatus is effected when the abnormality detection means detects abnormality of the sheet after-processing apparatus at a time when an operating mode using the sheet after-processing apparatus has been selected by the mode selection means.

* * * * *